US007261114B2

(12) United States Patent
Karasin et al.

(10) Patent No.: US 7,261,114 B2
(45) Date of Patent: Aug. 28, 2007

(54) ROLLING/BRAKING CANE

(75) Inventors: Craig Karasin, Moorestown, NJ (US); Robert Popek, Doylestown, PA (US); David Reed, Langhorne, PA (US); Andrew Vellrath, New Castle, DE (US); Thomas J. Powers, Fairless Hills, PA (US); Danny A. Freund, Hopewell, NJ (US)

(73) Assignee: Full Life Products, LLC, Moorestown, NJ (US)

( * ) Notice: Subject to any disclaimer, the term of this patent is extended or adjusted under 35 U.S.C. 154(b) by 0 days.

(21) Appl. No.: 11/257,699

(22) Filed: Oct. 25, 2005

(65) Prior Publication Data

US 2006/0162754 A1 Jul. 27, 2006

Related U.S. Application Data

(60) Provisional application No. 60/621,708, filed on Oct. 25, 2004, provisional application No. 60/621,754, filed on Oct. 25, 2004.

(51) Int. Cl.
*A45B 1/02* (2006.01)

(52) U.S. Cl. ..... 135/85

(58) Field of Classification Search ..... 135/65, 135/66, 67, 85
See application file for complete search history.

(56) References Cited

U.S. PATENT DOCUMENTS

| | | | | |
|---|---|---|---|---|
| 1,307,058 | A | 6/1919 | McGrath | |
| 1,917,440 | A * | 7/1933 | Finkbeiner et al. | 135/67 |
| 2,077,569 | A * | 4/1937 | Kish | 135/85 |
| 2,244,869 | A | 6/1941 | Everest et al. | |
| D142,549 | S | 10/1945 | Fink | |
| 2,792,874 | A * | 5/1957 | Sundberg | 135/67 |
| D187,450 | S | 3/1960 | Maxwell | |
| D187,842 | S | 5/1960 | Jeys | |
| 3,133,551 | A | 5/1964 | Murcott | |
| 3,157,187 | A | 11/1964 | Murcott | |
| 3,165,314 | A | 1/1965 | Clearman et al. | |
| 3,350,095 | A | 10/1967 | Clasman | |
| D218,602 | S | 9/1970 | Malasky | |
| D229,728 | S | 12/1973 | Thomas | |
| D230,531 | S | 2/1974 | Thomas | |
| 3,884,327 | A | 5/1975 | Zigman | |

(Continued)

FOREIGN PATENT DOCUMENTS

FR 2267750 A1 * 12/1975

(Continued)

OTHER PUBLICATIONS

Declaration of John Tartaglia executed May 4, 2005.

(Continued)

*Primary Examiner*—David Dunn
*Assistant Examiner*—Danielle Jackson
(74) *Attorney, Agent, or Firm*—Morgan Lewis & Bockius LLP

(57) ABSTRACT

A cane with a base having at least one wheel and an aperture, a support shaft having a user adjustable length and a first end connected to the base, a brake disposed within the aperture having a user adjustable length and at least one grip connected to the support shaft and the grip being operably engaged with the brake.

20 Claims, 28 Drawing Sheets

U.S. PATENT DOCUMENTS

| | | | | | |
|---|---|---|---|---|---|
| 4,044,784 | A | | 8/1977 | Smith | |
| 4,046,374 | A | | 9/1977 | Breyley | |
| 4,062,372 | A | | 12/1977 | Slusher | |
| 4,091,828 | A | | 5/1978 | Jorgensen | |
| 4,106,521 | A | | 8/1978 | Thomas | |
| 4,135,535 | A | | 1/1979 | Thomas | |
| 4,258,735 | A | | 3/1981 | Meade | |
| 4,274,430 | A | | 6/1981 | Schaaf et al. | |
| 4,341,381 | A | | 7/1982 | Norberg | |
| 4,342,465 | A | | 8/1982 | Stillings | |
| 4,378,862 | A | | 4/1983 | Carmel | |
| D272,677 | S | | 2/1984 | Bove et al. | |
| 4,559,962 | A | | 12/1985 | Marchiano | |
| 4,601,302 | A | | 7/1986 | Breen et al. | |
| D290,186 | S | | 6/1987 | Meunchen | |
| D295,694 | S | | 5/1988 | Mace | |
| 4,765,355 | A | * | 8/1988 | Kent | 135/67 |
| 4,787,405 | A | | 11/1988 | Karwoski | |
| 4,796,648 | A | | 1/1989 | Goulter | |
| 4,834,127 | A | | 5/1989 | Van Sice | |
| 4,884,587 | A | | 12/1989 | Mungons | |
| 4,962,781 | A | | 10/1990 | Kanbar | |
| 4,974,871 | A | | 12/1990 | Mao | |
| 4,993,446 | A | | 2/1991 | Yarbrough | |
| 4,997,001 | A | | 3/1991 | DiCarlo | |
| 5,020,560 | A | * | 6/1991 | Turbeville | 135/67 |
| 5,025,820 | A | | 6/1991 | Gamper | |
| 5,029,897 | A | * | 7/1991 | Borg | 135/66 |
| 5,056,545 | A | | 10/1991 | Spaeth | |
| D324,946 | S | | 3/1992 | Karten | |
| 5,112,044 | A | | 5/1992 | Dubats | |
| 5,127,664 | A | | 7/1992 | Cheng | |
| 5,131,494 | A | | 7/1992 | Heifetz | |
| D329,538 | S | | 9/1992 | Rau | |
| 5,156,176 | A | | 10/1992 | Doorenbos | |
| 5,168,947 | A | * | 12/1992 | Rodenborn | 180/19.1 |
| 5,188,138 | A | | 2/1993 | Yamasaki et al. | |
| 5,201,334 | A | | 4/1993 | Tseng | |
| 5,238,013 | A | | 8/1993 | Battiston et al. | |
| 5,282,486 | A | | 2/1994 | Hoover | |
| 5,301,704 | A | | 4/1994 | Brown | |
| 5,307,828 | A | | 5/1994 | Gardner et al. | |
| 5,318,057 | A | | 6/1994 | Wallum | |
| 5,339,850 | A | | 8/1994 | Mertz | |
| 5,355,904 | A | | 10/1994 | Wallum | |
| 5,385,163 | A | | 1/1995 | Fairchild | |
| 5,390,687 | A | | 2/1995 | Tsai | |
| 5,392,800 | A | | 2/1995 | Sergi | |
| 5,392,801 | A | | 2/1995 | Hannoosh et al. | |
| 5,433,234 | A | | 7/1995 | Lapere | |
| 5,482,070 | A | | 1/1996 | Kelly | |
| 5,495,867 | A | | 3/1996 | Block | |
| 5,499,645 | A | | 3/1996 | Baliga | |
| 5,588,457 | A | | 12/1996 | Tartaglia | |
| 5,636,651 | A | | 6/1997 | Einbinder | |
| 5,692,533 | A | | 12/1997 | Meltzer | |
| 5,785,070 | A | | 7/1998 | Block et al. | |
| 5,794,638 | A | | 8/1998 | Richey et al. | |
| D401,192 | S | | 11/1998 | Gagnon | |
| D411,343 | S | | 6/1999 | Brightbill et al. | |
| D411,653 | S | | 6/1999 | Richey et al. | |
| 5,938,240 | A | * | 8/1999 | Gairdner | 135/85 |
| 5,941,262 | A | | 8/1999 | Tschirhart | |
| 5,954,074 | A | | 9/1999 | Mattson | |
| 6,003,532 | A | | 12/1999 | Pi | |
| D422,747 | S | | 4/2000 | Evans | |
| D426,129 | S | | 6/2000 | Pringle et al. | |
| D428,367 | S | | 7/2000 | Lundh | |
| 6,158,453 | A | | 12/2000 | Nasco | |
| D439,625 | S | | 3/2001 | Tamaribuchi | |
| D441,162 | S | | 4/2001 | Groove et al. | |
| 6,217,056 | B1 | | 4/2001 | Tsuchie | |
| D442,446 | S | | 5/2001 | Hortnagl | |
| D444,605 | S | | 7/2001 | Porter | |
| D448,151 | S | | 9/2001 | Outlaw | |
| 6,318,392 | B1 | | 11/2001 | Chen | |
| 6,338,355 | B1 | | 1/2002 | Cheng | |
| D455,985 | S | | 4/2002 | Olivares | |
| D457,840 | S | | 5/2002 | Hsia | |
| 6,494,469 | B1 | | 12/2002 | Hara et al. | |
| D468,669 | S | | 1/2003 | Hopely, Jr. | |
| D480,995 | S | | 10/2003 | Owens | |
| 6,675,820 | B2 | | 1/2004 | Balan | |
| 6,708,705 | B2 | | 3/2004 | Nasco, Sr. | |
| 6,715,794 | B2 | | 4/2004 | Frank | |
| D494,109 | S | | 8/2004 | Karasin et al. | |
| 6,877,519 | B2 | | 4/2005 | Fink | |
| D506,419 | S | | 6/2005 | Coster | |
| D521,720 | S | * | 5/2006 | Karasin et al. | D3/7 |
| D522,342 | S | | 6/2006 | Kwan | |
| 2001/0038186 | A1 | | 11/2001 | Wychozowycz | |
| 2003/0094191 | A1 | | 5/2003 | Lin | |
| 2003/0111100 | A1 | | 6/2003 | Bell et al. | |
| 2003/0205265 | A1 | | 11/2003 | Nasco, Sr. | |
| 2004/0216776 | A1 | | 11/2004 | Otis | |
| 2005/0093326 | A1 | | 5/2005 | Miller et al. | |

FOREIGN PATENT DOCUMENTS

| | | | | |
|---|---|---|---|---|
| FR | 2285849 | A2 | * | 5/1976 |
| GB | 2057896 | | | 4/1981 |
| JP | 63-270054 | A | * | 11/1988 |
| JP | 10071181 | | | 3/1998 |
| JP | 2004-222879 | A | * | 8/2004 |
| JP | 2004357731 | | | 12/2004 |

OTHER PUBLICATIONS

Office Action dated Apr. 10, 2007 in co-pending U.S. Appl. No. 11/107,198.

* cited by examiner

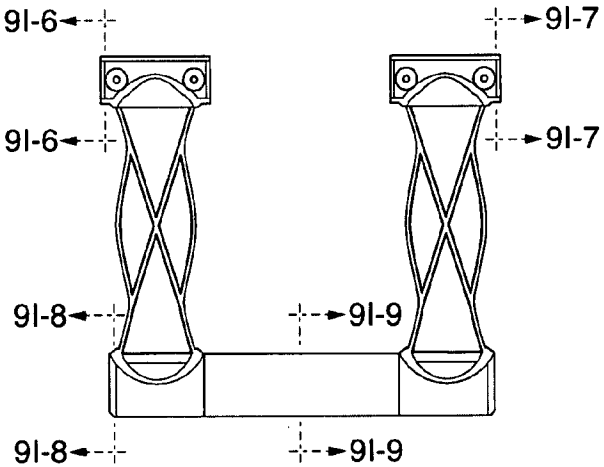
FIG. 9I-3
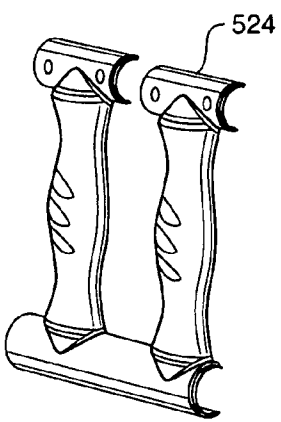
FIG. 9I-2
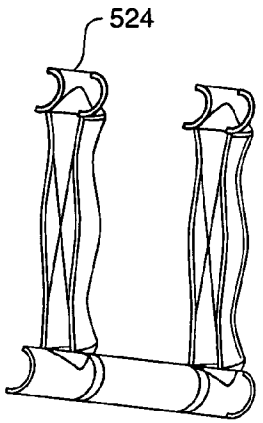
FIG. 9I-1
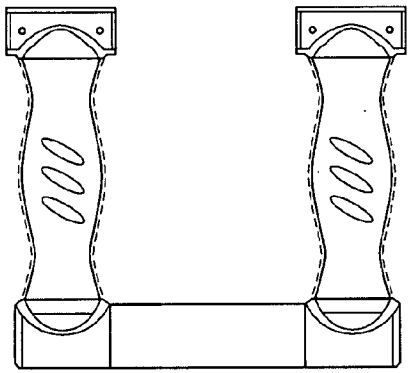
FIG. 9I-5
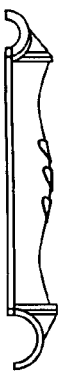
FIG. 9I-4
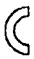
FIG. 9I-7
FIG. 9I-6
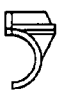
FIG. 9I-9
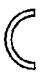
FIG. 9I-8

ROLLING/BRAKING CANE

RELATED APPLICATIONS

This application claims priority to U.S. Provisional Patent Application 60/621,708 and U.S. Provisional Patent Application 60/621,754 both of which were filed Oct. 25, 2004 and which are hereby incorporated by reference in their entirety.

INCORPORATION BY REFERENCE

All references cited herein are hereby incorporated by reference as if set forth in their entirety herewith. Also incorporated by reference in its entirety is U.S. patent application Ser. No. 11/257,807 of Karasin et al. entitled STEP-UP DEVICE filed Oct. 25, 2005.

SUMMARY OF PREFERRED EMBODIMENTS

In one embodiment there is a cane having a base with at least one wheel and an aperture; a support shaft having a user adjustable length and a first end connected to the base; a brake disposed within the aperture having a user adjustable length; and at least one grip connected to the support shaft and the grip being operably engaged with the brake. In one embodiment, the at least one grip comprises a plurality of intermediate grips, each grip being configured to apply the brake with application of downward force and being configured to release the brake with the removal of the downward force. In one embodiment, the cane has two rear wheels that rotate about a common axis and two forward castors. In a further embodiment, the base has a bumper disposed on a front face of the base. In a still further embodiment of the cane, the grip includes an actuator that is displaceable relative to a portion of the grip to engage the brake. In a further embodiment, the cane includes a grip that includes an outer grip having an aperture defining an ornamental feature. In another embodiment, the cane includes a brake that is configured to form a stiffening member for the cane. In a further embodiment, the brake operably engages a bias element configured to bias the brake in a released position. In a still further embodiment, the cane has a base with a stepped vertical profile. In another embodiment, the cane includes two castors secured to an upper portion of the stepped vertical profile base and two fixed axle wheels secured to a lower portion of the stepped vertical profile base. In a further embodiment of the cane, a brake is disposed proximate the fixed axle wheels and passes through the stepped vertical profile base to be engageable with a ground surface. Another embodiment of the cane includes at least one brake guide that engages one of the grips, a brake collar that positions the brake, and an actuator guide disposed within the actuator and configured to guide the actuator when it is displaced from the grip to apply the brake. A further embodiment of the cane includes forward wheels and rearward wheels and a brake disposed between the forward wheels and the rearward wheels. In one embodiment of the cane, the brake is proximate a forward end of the rearward wheels. In one embodiment of the cane, grips are configured to permit a user to apply the brake while the user's hand is comfortably positioned on at least one of the grips.

In one embodiment there is a cane having a base with a plurality of wheels; an adjustable length upright structure connecting the base with a grip; and an adjustable length brake means for preventing the cane from rolling. One embodiment of the cane also includes at least one grip means for orienting a user's hand into a position from which the brake is appliable without removing the hand from the grip means. In one embodiment of the cane, the base is a stepped profile base. A further embodiment of the cane also includes an accessory fixture. In one embodiment of the cane, the brake means comprises a actuator guide means for guiding an actuator when the brake is applied and when the brake is released.

BRIEF DESCRIPTION OF THE DRAWINGS

Reference is made to the accompanying drawings in which are shown illustrative embodiments of the invention, from which its novel features and advantages will be apparent. In the drawings:

FIGS. 9A-1 to 9A-2-9L-1 to 9L-6 illustrate several elements of a rolling/braking cane according to the present invention including shaft 300 (FIG. 9A-1 to 9A-2); base 200 (FIG. 9B-1 to 9B-7); split ring 316 (FIG. 9C1 to 9C-2); collet nut 314 (FIG. 9D-1 to 9D-3); lower shaft 310 (FIG. 9E-1 to 9E-3); bumper 220 (FIG. 9F-1 to 9F-3); lower brake 410 (FIG. 9G-1 to 9G-2); axle 213 (FIG. 9H-1 to 9H-2); lower intermediate grip 520 (FIG. 9I-1 to 9I-9); upper grip 510 (FIG. 9J-1 to 9J-8); upper brake 420 (FIG. 9K-1 to 9K-3); grip with accessory 700 (FIG. 9L-1 to 9L-6).

DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts. To provide a thorough understanding of the present invention, numerous specific details of preferred embodiments are set forth including material types, dimensions, and procedures. Practitioners will understand that the embodiments of the invention may be practiced without many of these details. In other instances, well-known devices, methods, and processes have not been described in detail to avoid obscuring the invention.

Figure 1A:
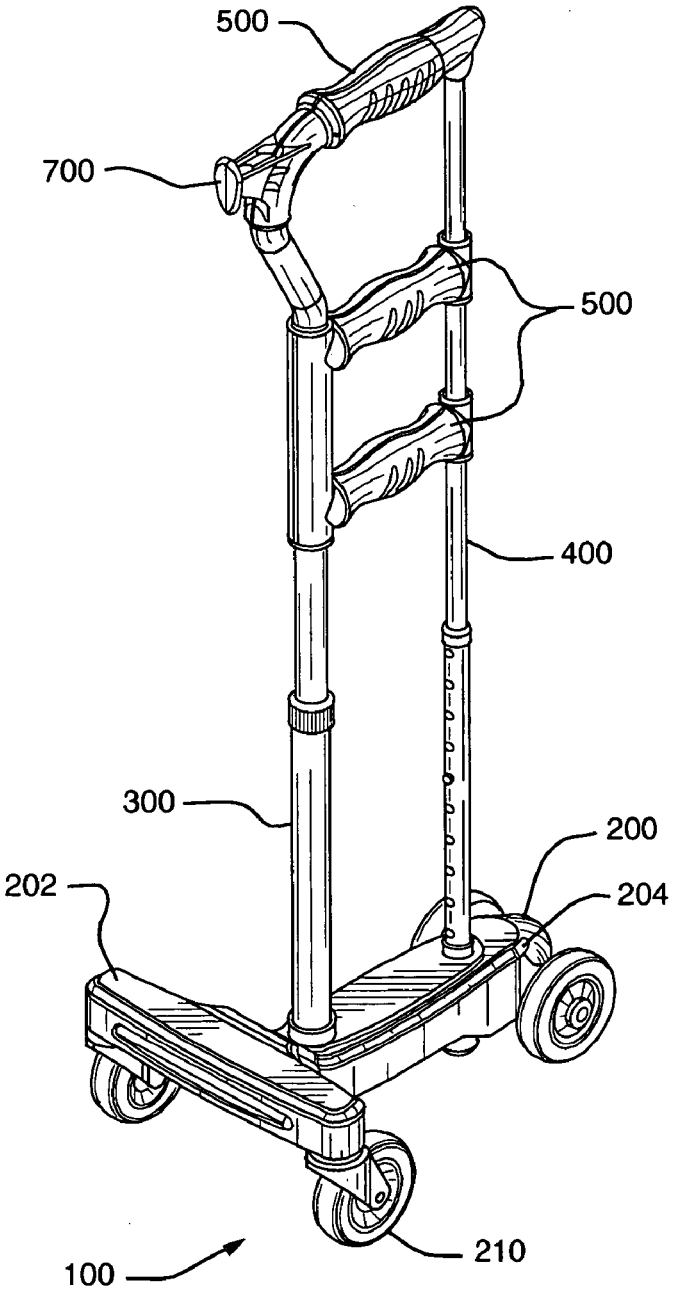
FIGS. 1A-1H depict different views of a rolling cane according to the present invention.
Figure 1B:
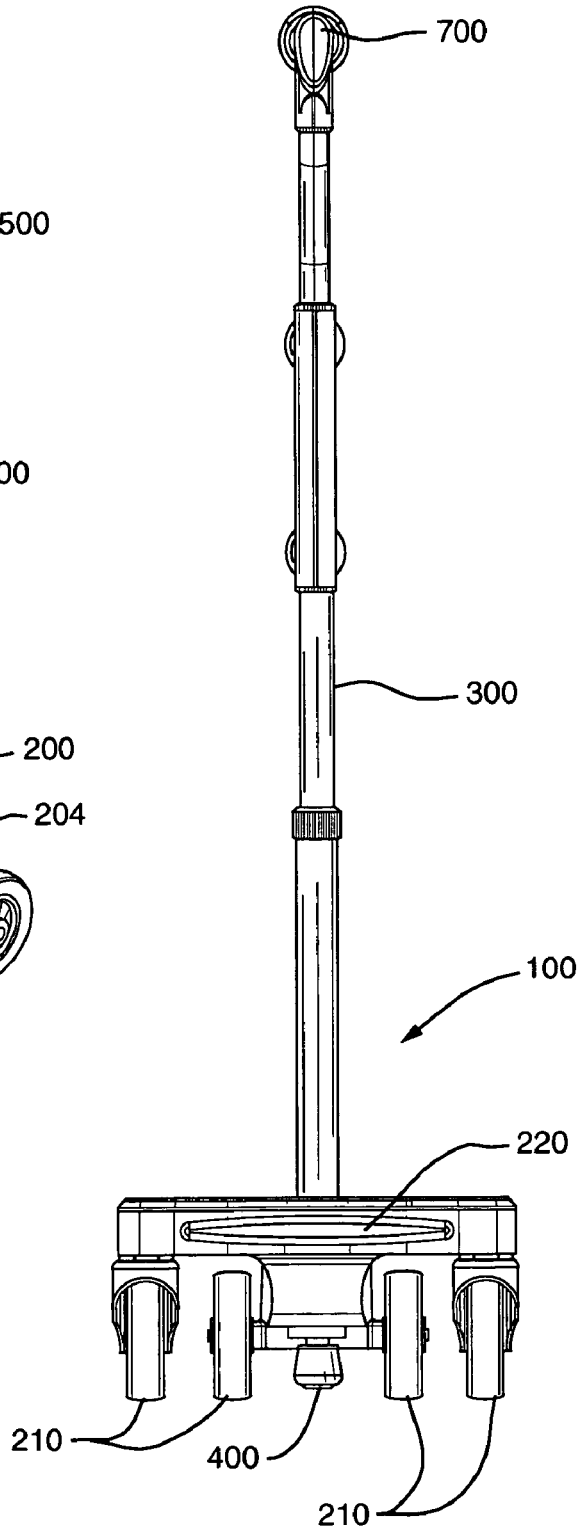
Figure 1D:
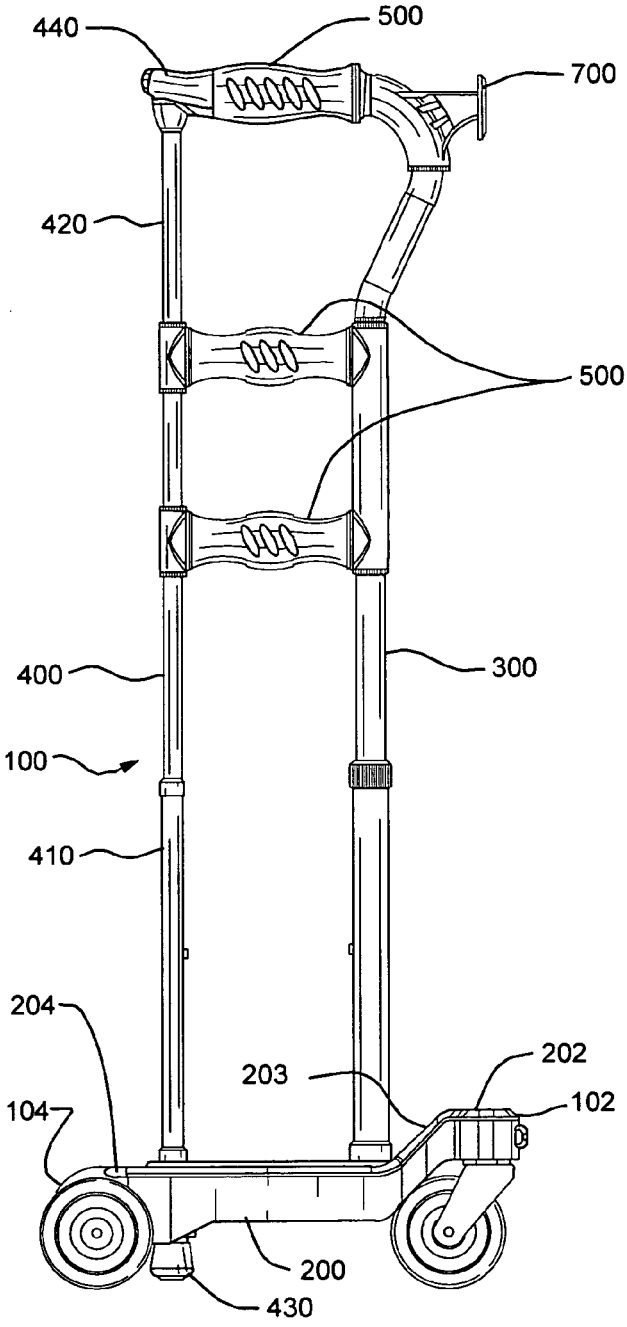
Figure 1C:
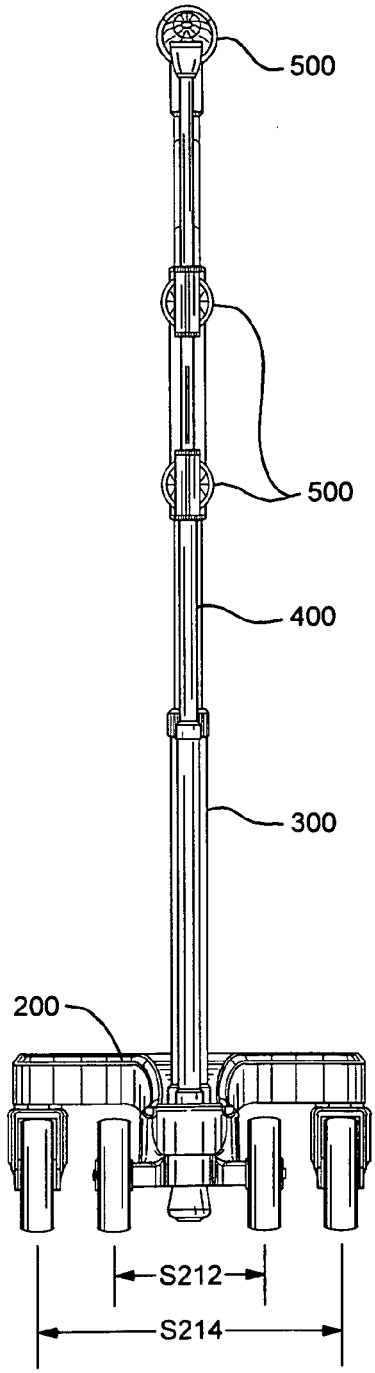
Figure 1F:
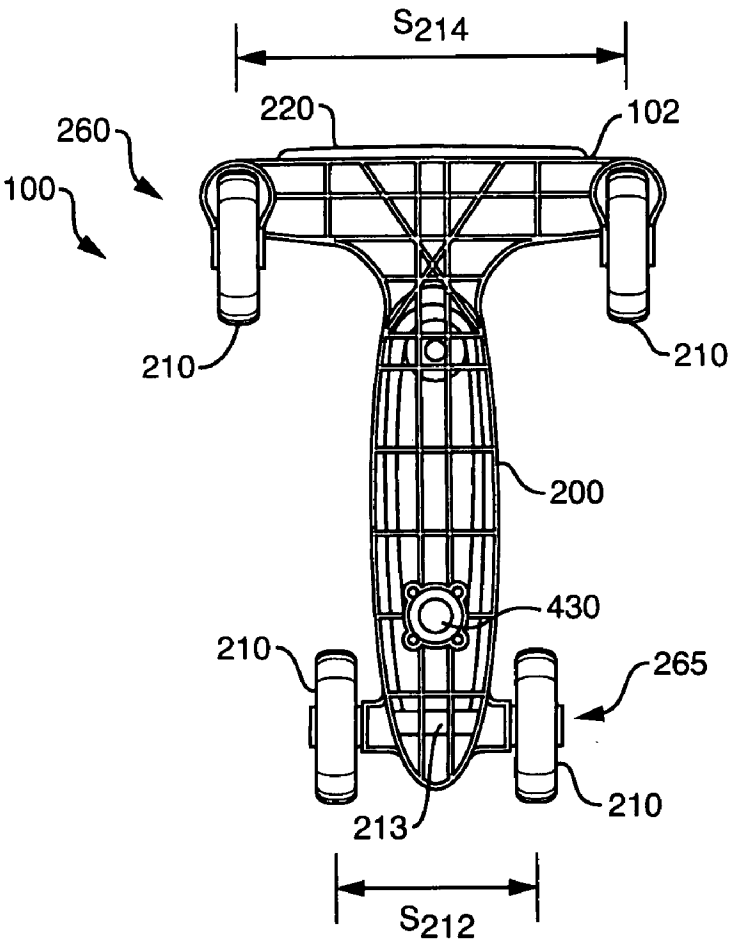
Figure 1E:
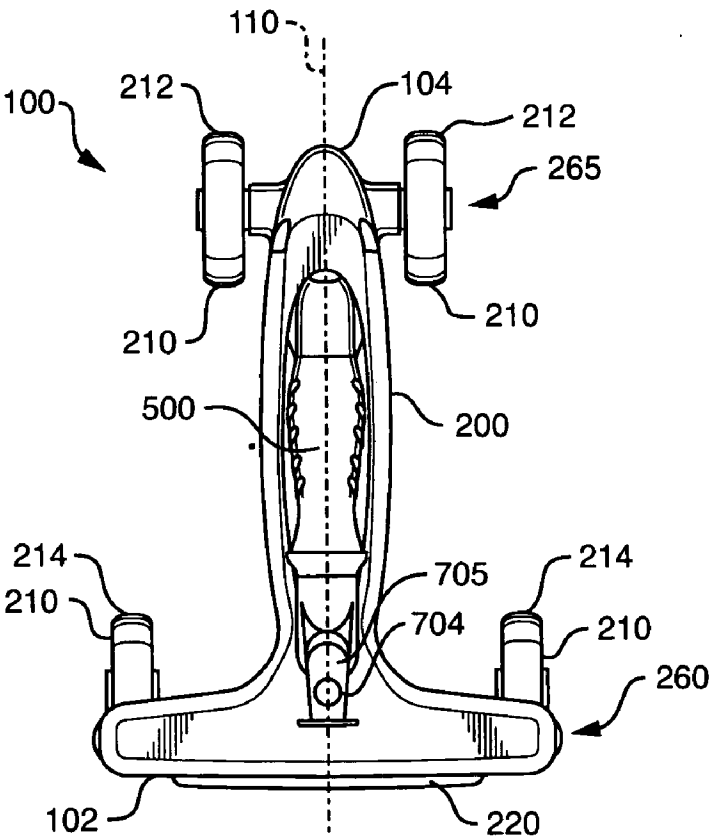

The present invention is directed to a rolling cane device having a brake for preventing the cane from rolling (including stopping a rolling cane and keeping a stationary cane from rolling). FIGS. 1A-1H illustrate one embodiment of cane 100 of the present invention. Cane 100 preferably includes base 200, shaft 300, brake 400, grip(s) 500, brake guide 600 (e.g., FIGS. 1H, 3, 4B, 5 and 6) and accessory device 700. In one embodiment, cane 100 is constructed of any material selected by those of skill in the art including metal, polymer, fiberglass, 25% to 40% fiberglass filed nylon, or any combination or composite thereof. In one embodiment, portions of cane 100 (e.g., shaft 300 and brake 400) are aluminum. In a preferred embodiment, cane 100 has a front 102 and a rear 104. Cane 100 preferably is substantially symmetric about longitudinal axis 110 (FIG. 1E).

Figure 2:
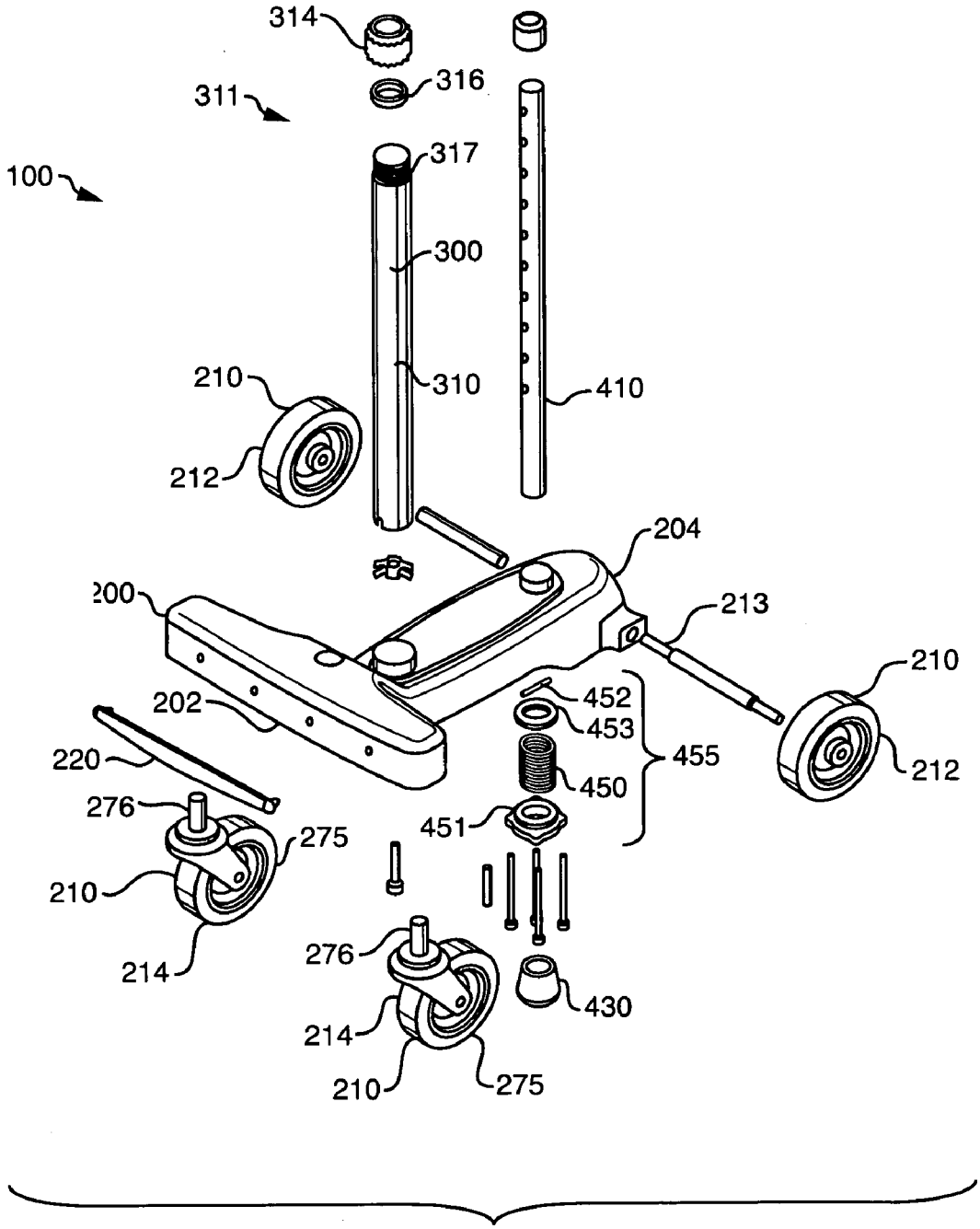
FIG. 2 depicts a disassembled rolling cane shown in FIGS. 1A-1H according to the present invention.
Figure 3:
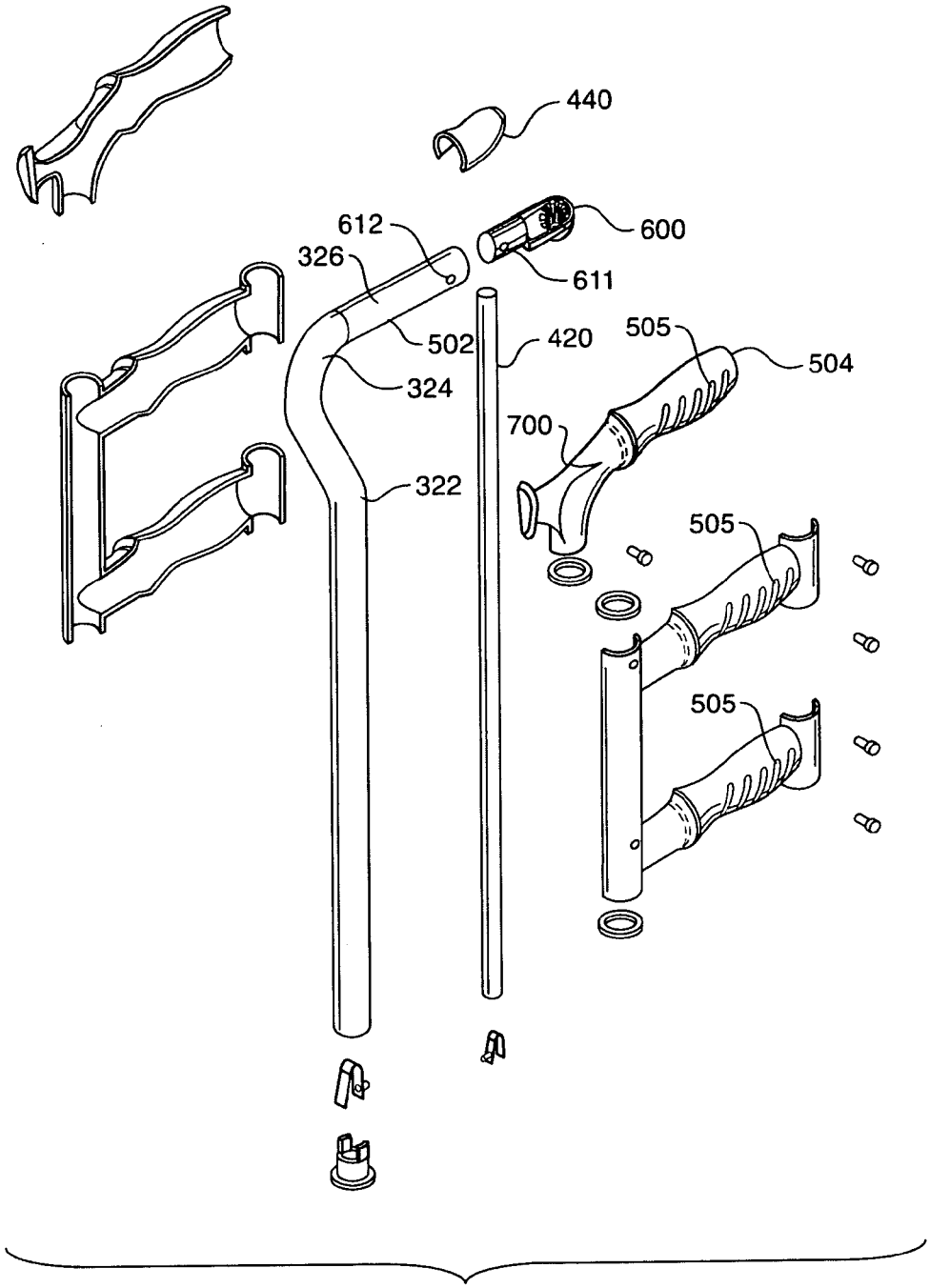
FIG. 3 depicts a disassembled rolling cane shown in FIGS. 1A-1H according to the present invention.

In a preferred embodiment, base 200 has wheels 210 (FIG. 2). In one embodiment, cane 100 has any number of wheels. Preferably, cane 100 has four wheels. Preferably, base 200 has two rear wheels 212 and two forward wheels 214. In a preferred embodiment, one or more wheels 210 rotate about an axle 213 having a axis that is oriented in a fixed position relative to base 200. In one embodiment, cane 100 has two rear wheels 212 with axles 213 having axes fixed relative to base 210. In one embodiment, two or more wheels (e.g., rear wheels 212) rotate about a common axle 213. In another embodiment (not shown), any number of wheels 210 rotate about individual axles 213. In one embodiment, one or more of wheels 210 include castors 275 (FIG. 2). In a preferred embodiment, castors 275 rotate about stem 276 to improve the maneuverability of cane 100. In one embodiment, illustrated in FIG. 2, rear wheels 212 rotate about a common axle 213 and forward wheels 214 are castors 275. Preferably, wheels 210 are each of the same diameter. In one embodiment, two or more of wheels 210 have the same or different diameters. In one embodiment, shown in FIG. 1C, rear wheels 212 have a spacing $S_{212}$ that is the same or different than the spacing $S_{214}$ of front wheels 214 (FIG. 1F). In one embodiment, spacing $S_{212}$ is less than spacing $S_{214}$.

Base 200 may be of any shape. In one embodiment, front end 102 has a concave or convex curvature. In one embodiment, front end 102 of base 200 is substantially flat. In one embodiment (see, e.g., FIGS. 1E, 1F) base 200 is substantially T-shaped. In one embodiment, wheels 210 that include castors are positioned proximate the edge of wide end 260 of the T-shaped base 200 and wheels 210 sharing a common axle are positioned proximate the narrow end 265 of the T-shaped base (see, e.g., FIG. 1F).

Figures 1, 9A:
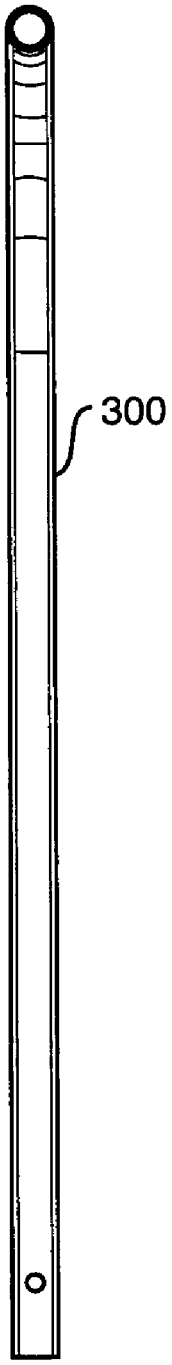
Figures 2, 9A:
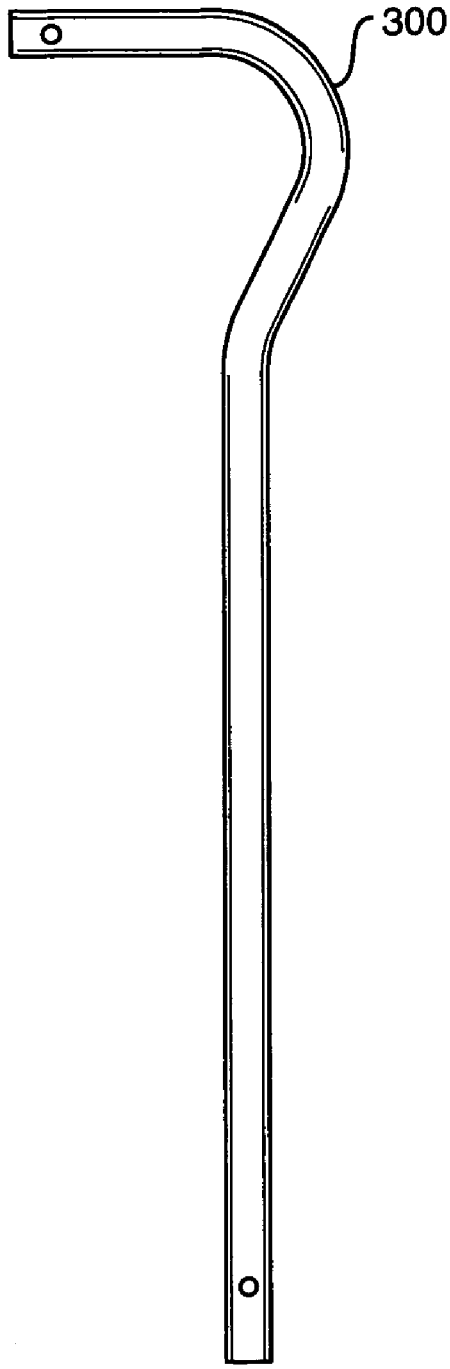
Figures 3, 9B:
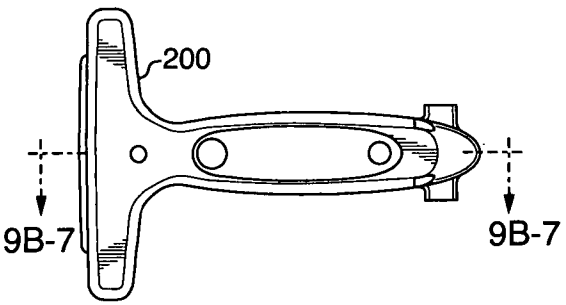
Figures 2, 9B:
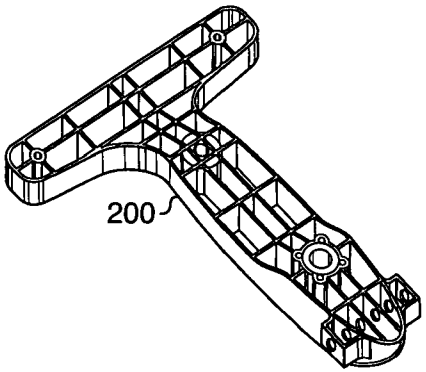
Figures 1, 9B:
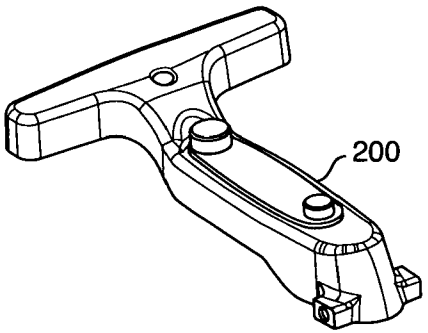
Figures 7, 9B:
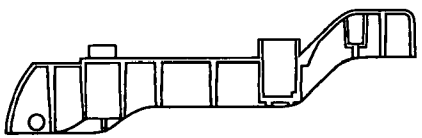
Figures 6, 9B:
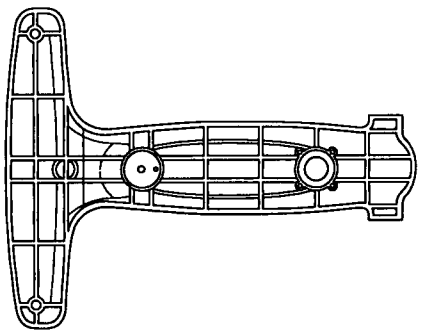
Figures 5, 9B:
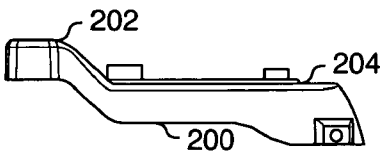
Figures 4, 9B:
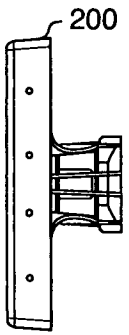
Figures 1, 9C:
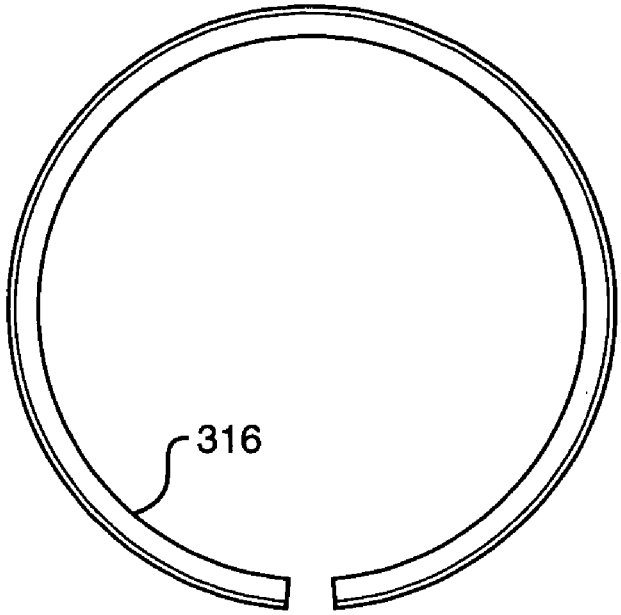
Figures 2, 9C:
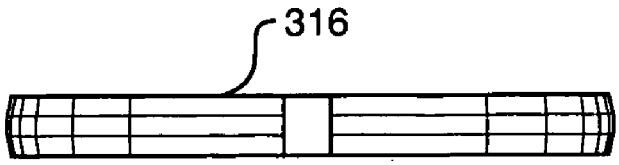
Figures 1, 9D:
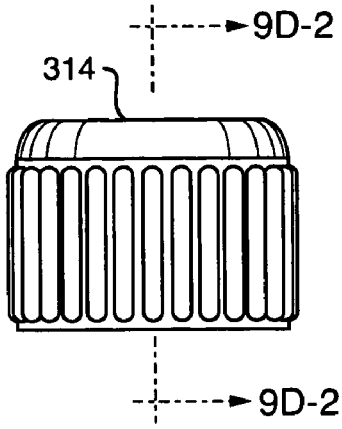
Figures 2, 9D:
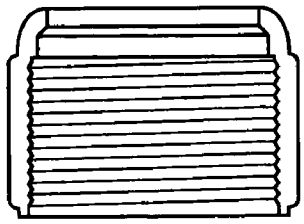
Figures 3, 9D:
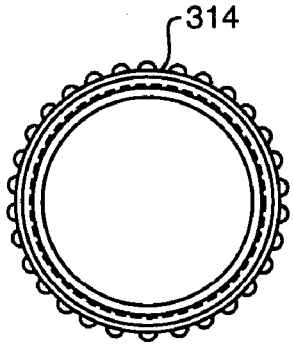
Figures 1, 9E:
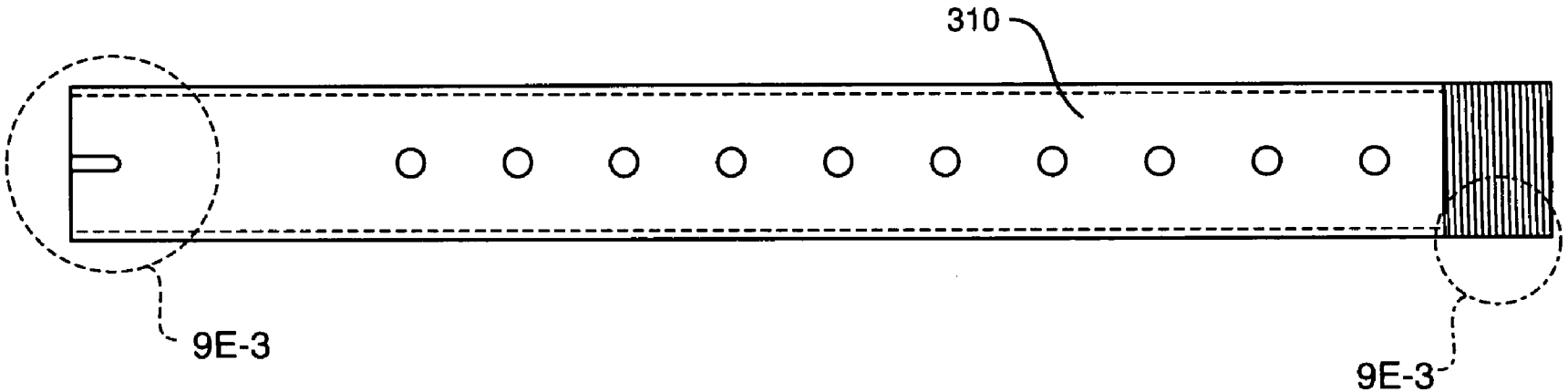
Figures 3, 9E:
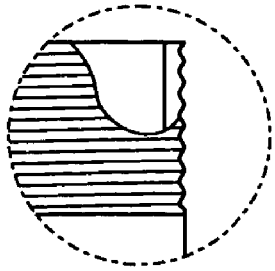
Figures 2, 9E:
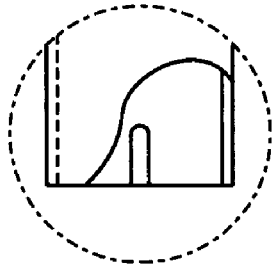
Figures 1, 9F:
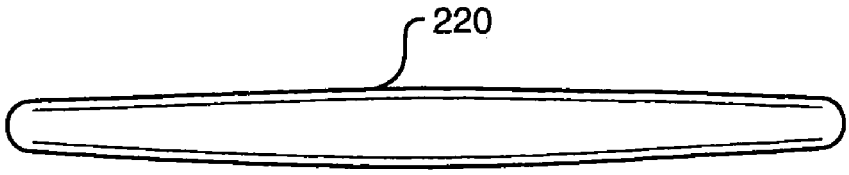
Figures 2, 9F:
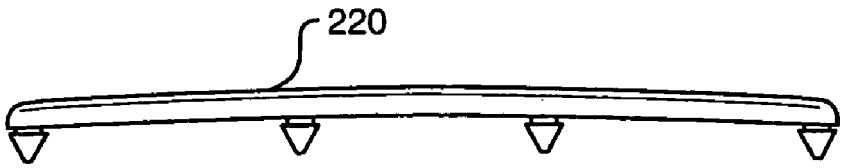
Figures 3, 9F:
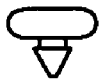
Figures 1, 9G:
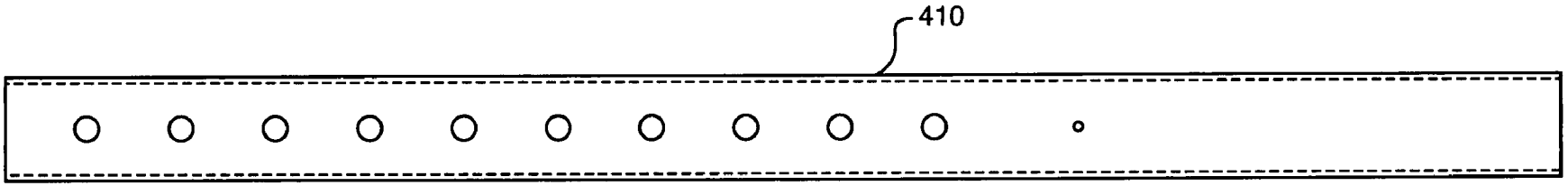
Figures 2, 9G:
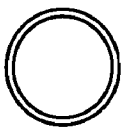
Figures 1, 9H:
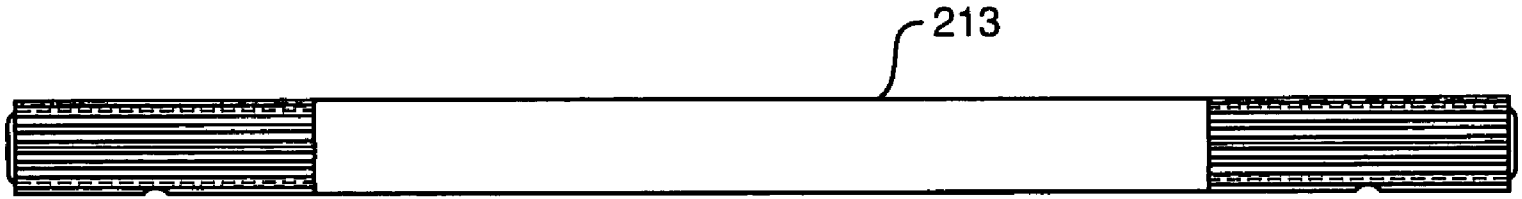
Figures 2, 9H:
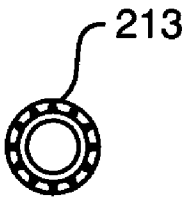
Figures 3, 9J:
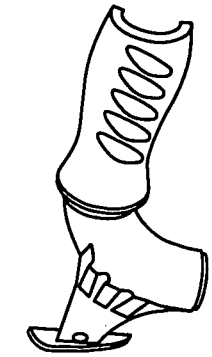
Figures 6, 9J:
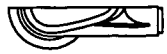
Figures 2, 9J:
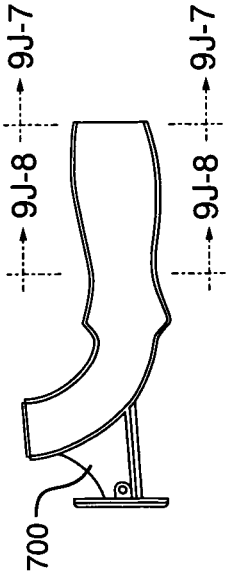
Figures 5, 9J:
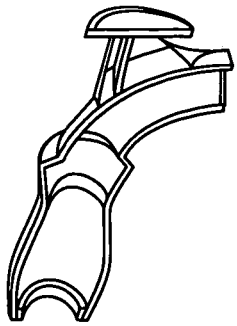
Figures 8, 9J:
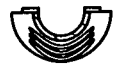
Figures 7, 9J:
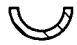
Figures 1, 9J:
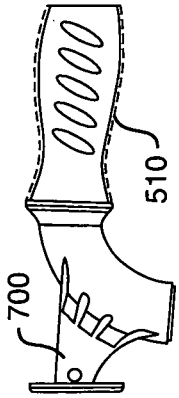
Figures 4, 9J:
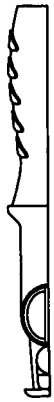
Figures 1, 9K:
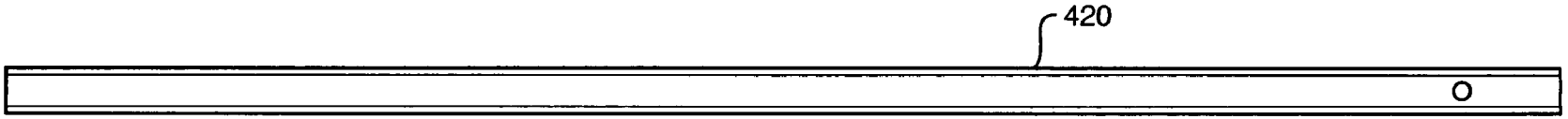
Figures 2, 9K:
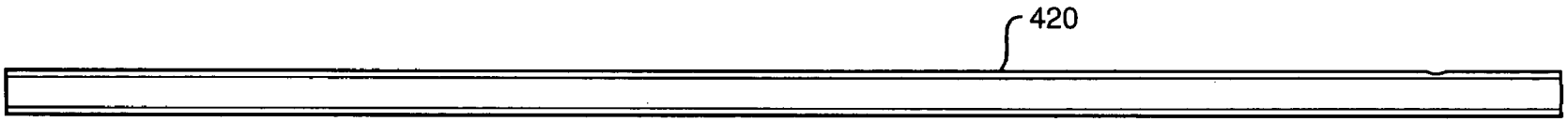
Figures 3, 9K:
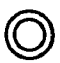
Figures 2, 9L:
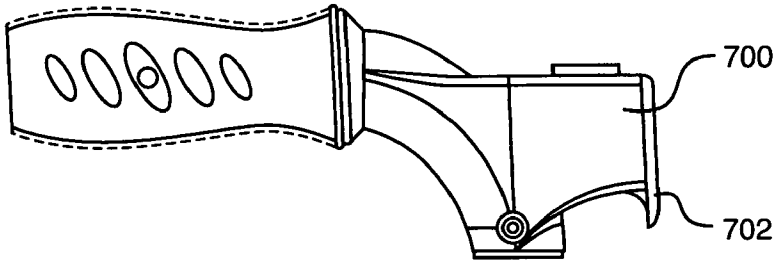
Figures 4, 9L:
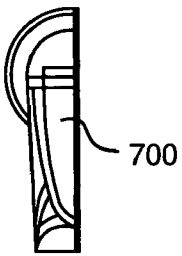
Figures 6, 9L:
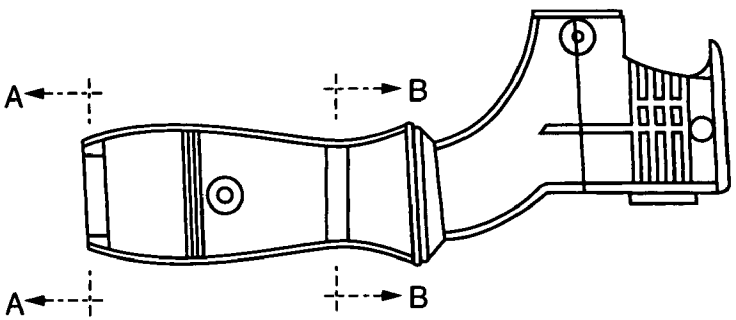
Figures 1, 9L:
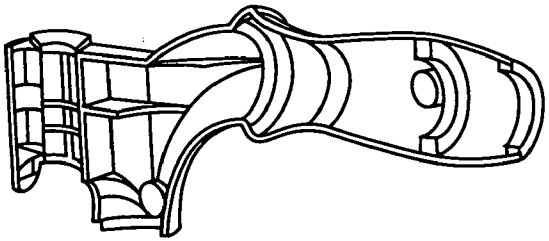
Figures 3, 9L:
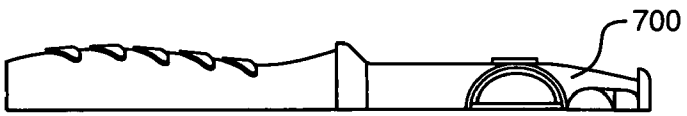
Figures 5, 9L:
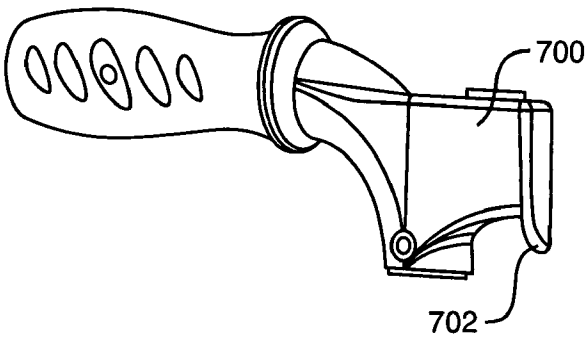

In one embodiment (not shown), base 200 has a substantially even (e.g., flat) vertical profile. In a preferred embodiment, illustrated in FIG. 1D, base 200 has a stepped vertical profile. By stepped vertical profile is meant that in elevation view, base 200 has at least two tiers (e.g., at different elevations). For example, as shown in FIGS. 1D and 9B, base 200 has a lower tier 204 and higher tier 202. In one embodiment, the distance between the top of higher tier 202 and the bottom of lower tier 204 is approximately between 3 inches and 5 inches, preferably approximately 3 inches to 4 inches, more preferably 3.6 inches. Lower tier 204 or higher tier 202 may be at any location along base 200. In one embodiment illustrated in FIG. 1D, lower tier 204 is proximate rear end 104 of base 200 and higher tier 202 is proximate front end 102 of base 200. In one embodiment, wheels 210 (e.g., castors 275) are positioned proximate higher tier 202 and wheels 210 having fixed axles are positioned at lower tier 204. In one embodiment, the use of fixed axle wheels permits the use of a lower profile base 200. In one embodiment, a lower profile base is preferable because it maximizes the height adjustability of cane 100 and lowers its center of gravity. In one embodiment, a higher profile base allows for the use of castors that swivel and therefore have improved maneuverability. In one embodiment, that includes a stepped profile base (e.g., having a stepped elevation), the base is configured for both a low center of gravity and improved maneuverability. In the embodiment of FIG. 1D higher tier 202 and lower tier 204 are connected by tier transition 203. In one embodiment, tier transition 203 includes a smooth and/or gradual transition. In another embodiment, tier transition 203 includes a sharp and/or abrupt transition.

In one embodiment, base 200 has bumper 220, shown in FIG. 1E. Bumper 220 is preferably configured to ram against solid objects without substantially damaging the object or cane 100. For example, a user may push cane 100 against a door to open it or keep it from closing. In one embodiment, bumper 220 is constructed of any material. In one embodiment, bumper 220 preferably is a material having at least some elasticity such as elastomer or rubber.

Shaft 300 is preferably secured to base 200 using any means. In a preferred embodiment, shaft 300 is configured to be supportable of substantially all force applied to cane 100 by a user during operation. In one embodiment, shaft 300 is secured to base 200 at any position along longitudinal axis 110. In one embodiment, shaft 300 is secured to base 200 proximate front end 102 of base 200. In the embodiment, of FIG. 1D, shaft 300 is secured to base 200 at lower tier 204. In one embodiment, shaft 300 is positioned rearward of the front wheels 214 of cane 100. FIG. 1D also illustrates an embodiment wherein shaft 300 is secured to base 200 proximate tier transition 203. Preferably shaft 300 and base 200 are configured such that when weight is applied to one of the grips 500, cane 100 is balanced.

Figure 1G:
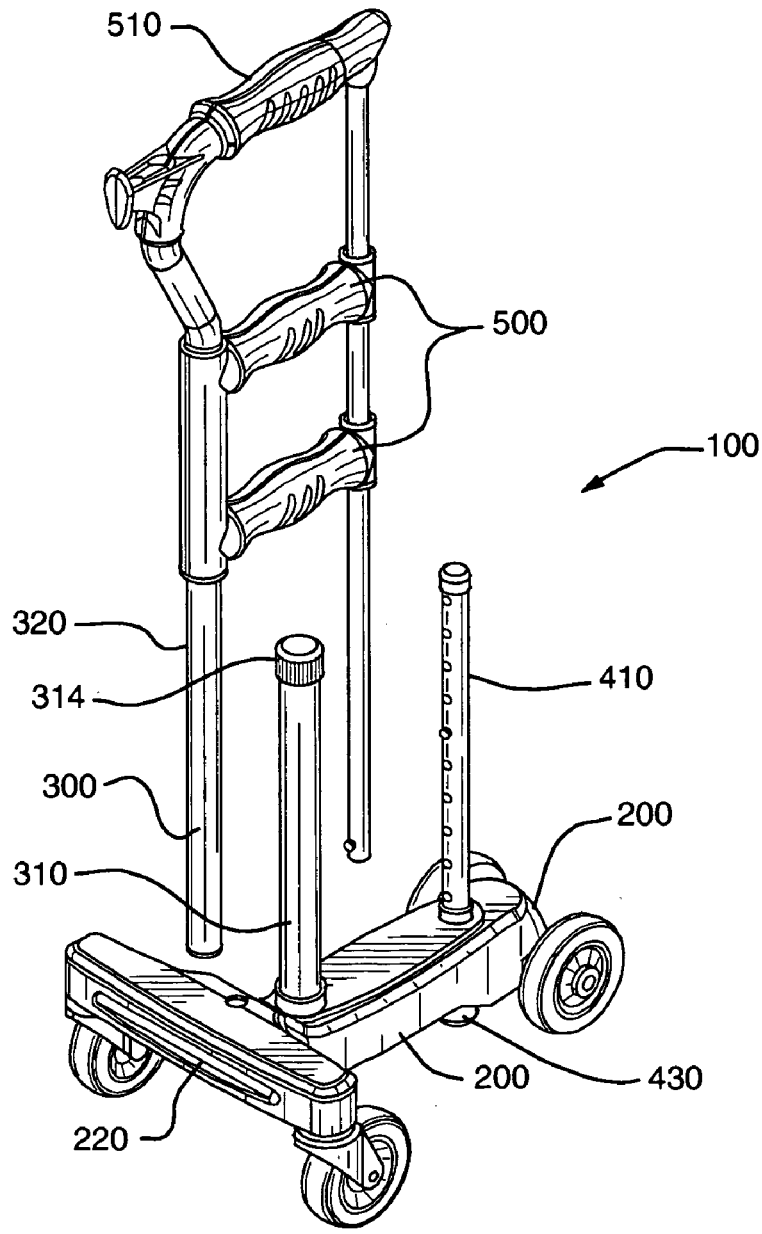
Figure 1H:
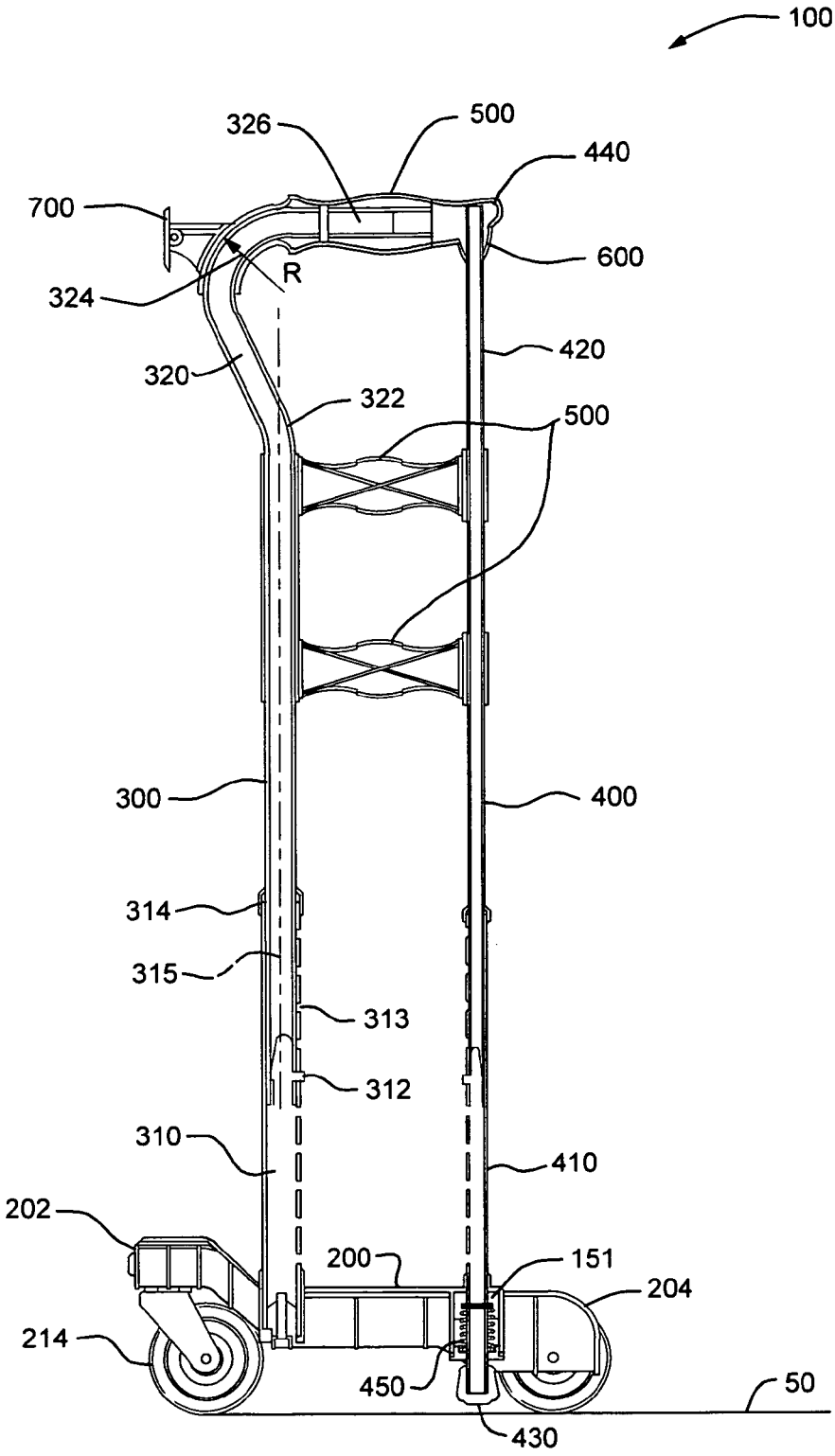

In one embodiment, shaft 300 is of a fixed length. In a preferred embodiment, shaft 300 is of an adjustable length. (FIGS. 1G and 1H). Preferably, shaft 300 has lower shaft 310 and upper shaft 320. In one embodiment lower shaft 310 and upper shaft 320 are tubular members of either the same or different diameters. In a preferred embodiment, upper shaft 320 has a smaller diameter than lower shaft 310. Preferably, upper shaft 320 fits within lower shaft 310. In one embodiment, the height of shaft 300 is adjusted by changing the position of upper shaft 320 with respect to lower shaft 310. Preferably, shaft 300 is locked to a desired height by matching a resilient spring pin 312 with a desired shaft notch 313. In one embodiment, spring pin 312 and shaft notch 313 are on either one of lower shaft 310 or upper shaft 320. In one embodiment, shaft 300 includes anti-rattle element 311. In one embodiment, anti-rattle element 311 preferably includes collet nut 314 and split ring 316. In a preferred embodiment, collet nut 314 is tightened to secure shaft 300 (FIGS. 1G, 1H, 2). In a preferred embodiment, split ring 316 is interposed between collet nut 314 and lower shaft 310. Preferably collet nut 314 includes an interior beveled edge (not shown) and lower shaft 310 has an opposing beveled edge 317. As collet nut 314 is tightened, ring 316 is wedged between the opposing beveled edges of collet nut 314 and lower shaft 310 reducing its diameter and compressing it against upper shaft 320.

In a preferred embodiment, shaft 300 extends substantially vertically with respect to base 200. In one embodiment, upper shaft 320 and lower shaft 310 are both substantially normal with respect to the base 200. In one embodiment shaft 300 is curved. In one embodiment, lower shaft 310 is substantially disposed about longitudinal axis 315. In a preferred embodiment, upper shaft 320 is bent with respect to longitudinal axis 315 (FIG. 1H). In one embodiment, upper shaft 320 has first inflection point 322 closer to grips 500 than to base 200. In one embodiment, upper shaft 320 protrudes toward front end 102 of cane 100 at first inflection point 322. In one embodiment, upper shaft 320 has elbow 324 above first inflection point 322. In one embodiment upper shaft 320 includes lateral member 326. Preferably, lateral member 326 extends rearward from base shaft longitudinal axis 315. Lateral member 326 preferably extends substantially parallel to datum surface 50 and substantially parallel to longitudinal axis 110. In one embodiment, illustrated in FIG. 1L, lateral member 326 forms an acute angle or an obtuse angle with datum 50 as it extends from base shaft longitudinal axis 315 rearward.

In one embodiment, shaft 300 is configured to permit an accessory to hang or otherwise depend from a forward point on shaft 300 without the accessory interfering with shaft 300. In one embodiment, accessory fixture 700 (described in more detail below) is attached to shaft 300 to accommodate such an accessory. In one embodiment, shaft 300 is configured such that accessory fixture 700 accepts heavy accessories without causing cane 100 to tip. In one embodiment, accessory fixture 700 does not extend forward of front wheels 214. In one embodiment, accessory fixture 700 extends slightly forward of front wheel 214.

Figure 4A:
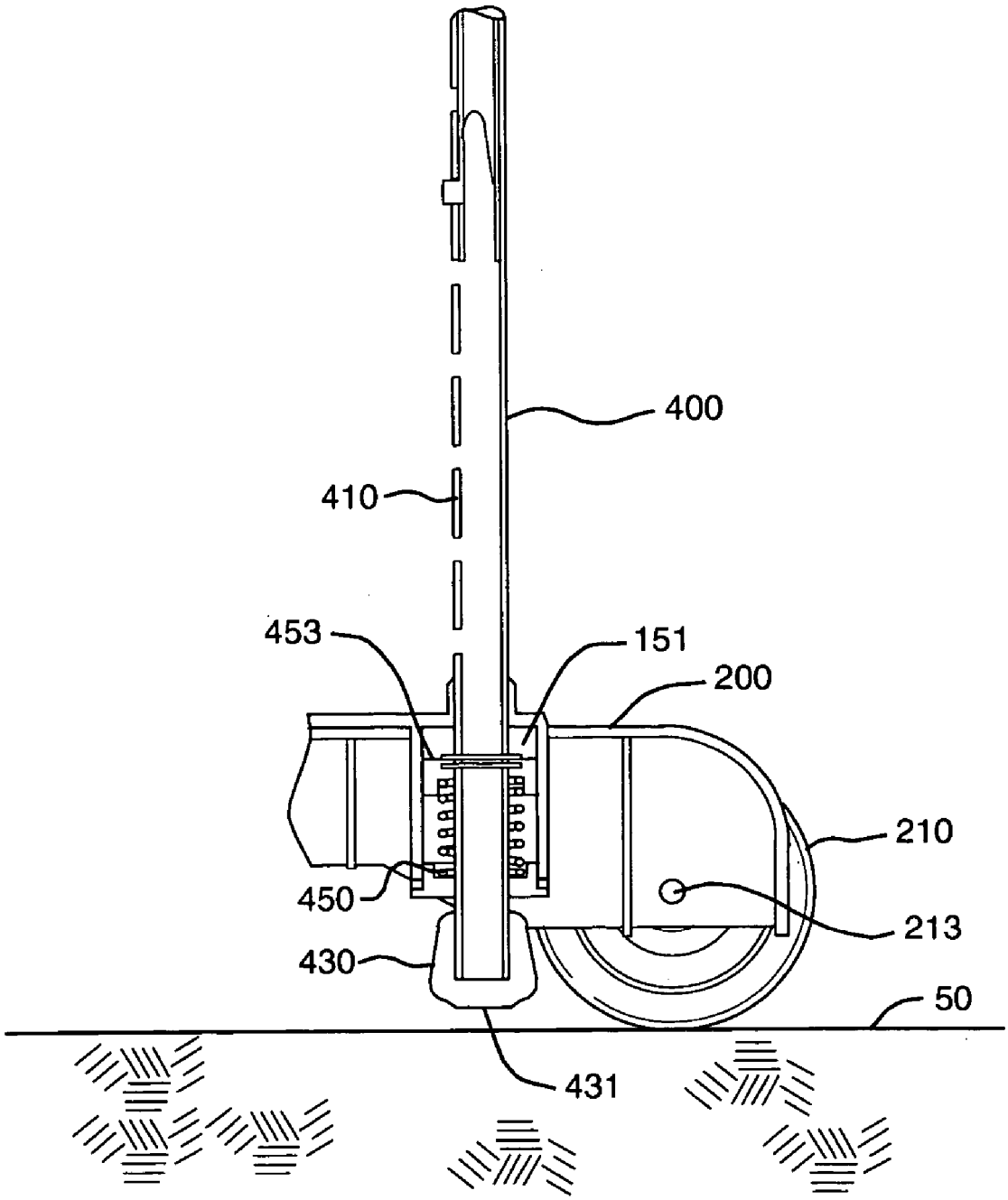
FIG. 4A depicts a cross section of a portion of the rolling cane shown in FIGS. 1A-1H according to the present invention.
Figure 4B:
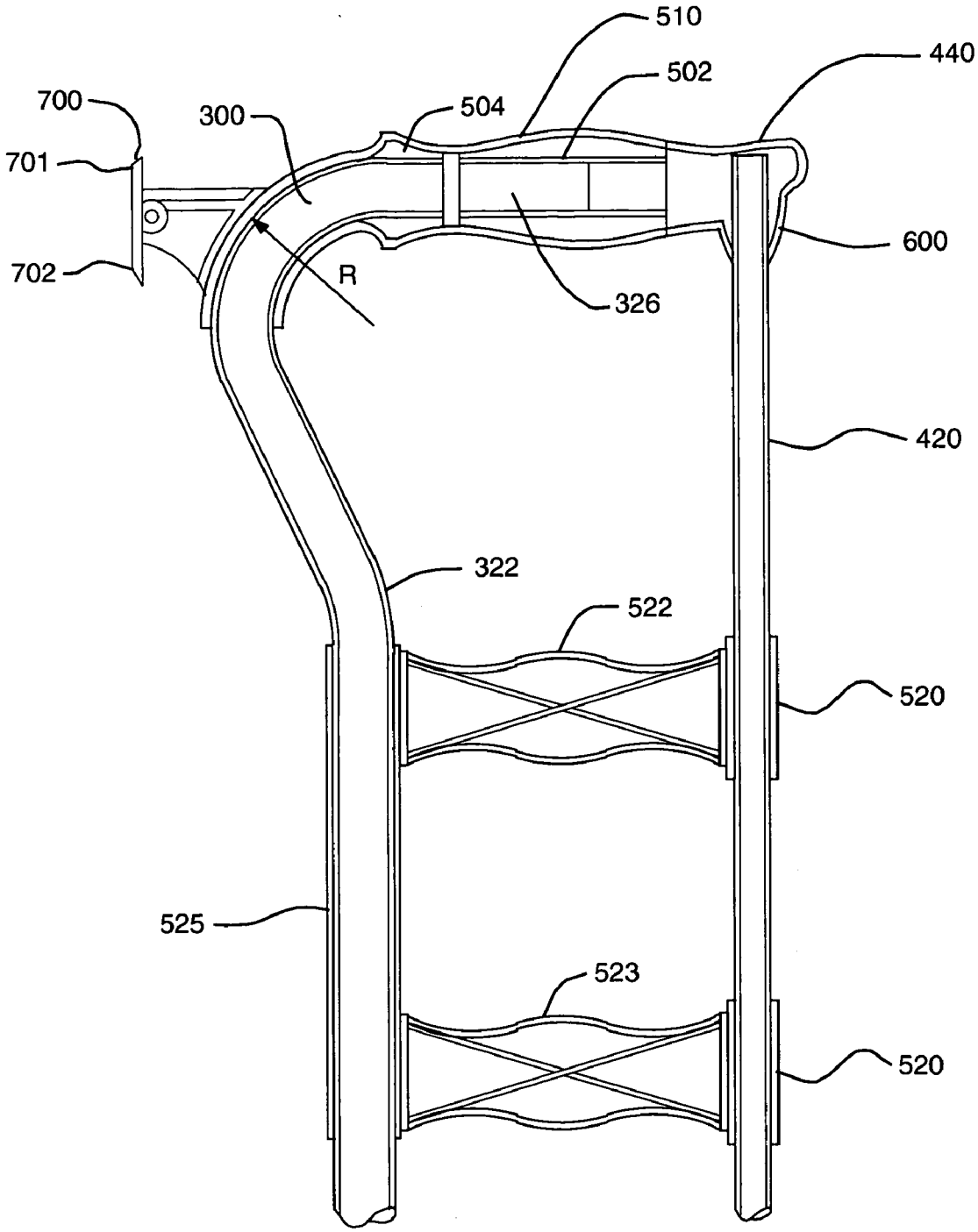
FIG. 4B depicts a cross section of a portion of the rolling cane shown in FIGS. 1A-1H according to the present invention.

In a preferred embodiment, shaft 300 is configured to form a substantially contiguous transition from substantially upright (e.g., normal to datum 50) to substantially horizontal (e.g., parallel to datum 50) (FIGS. 1H, 4B). In one embodiment, a substantially horizontal portion of shaft 300 forms a portion of a grip 500 (e.g., at least a portion of grip 500 is contiguous with shaft 300). In one embodiment, shaft 300 is any shape that will accommodate a length of grip 500 that is substantially at least as long as the distance between brake 400 and shaft 300. Preferably the distance between longitudinal axis 315 and the center of brake 400 is between approximately 5 and approximately 7 inches, preferably between approximately 5 inches to 6 inches, more preferably 5¼ inches. In one embodiment, shaft 300 and lateral member 326 are substantially perpendicular. In one embodiment, the perpendicular alignment between shaft 300 and lateral member 326 is achieved, for example, by welding or gluing shaft 300 to lateral member 326. Preferably, there is a contiguous transition from upper shaft 320 and lateral member 326 that is in the form a gooseneck-type configuration (e.g., FIG. 9A A-1 to 9A-2). In one embodiment, shaft 300 is configured to enable a pole (e.g., an intravenous pole, not shown) to engage accessory fixture 700 and base 200. In one embodiment, lateral member 326 forms a base upon which upper grip 510 is attached (FIG. 4B). In one embodiment, the length of lateral member 326 is selected to accommodate the desired length of upper grip 510. In one embodiment, the arc radius R of elbow 324 is selected to accommodate the desired length of upper grip 510 and the desired distance between lateral member 326 and inflection point 322. In one embodiment, R is approximately the smallest radius practicable for the material selected.

In one embodiment, brake 400 includes lower brake 410, upper brake 420, stopper 430, actuator 440 and bias element 450 (FIG. 1H). In one embodiment, lower brake 410 and upper brake 420 are a single contiguous piece or multiple pieces. In a preferred embodiment, brake 400 has an adjustable length. Lower brake 410 and upper brake 420 preferably are tubular structures. Preferably the length of brake 400 is adjustable and securable in a manner similar to the manner in which shaft 300 is adjusted and secured. Brake 400 can be located in any position with respect to base 200. In one embodiment, an example of which is illustrated in FIGS. 1H and 4A, brake 400 is disposed in aperture 151 of base 200. In one embodiment, brake 400 extends through aperture 151 and is at least partially exposed below base 200 in at least one of an applied (e.g., engaged) and a released position (e.g., a retracted position). In one embodiment, brake 400 is aligned on longitudinal axis 110 of base 200. In a preferred embodiment, brake 400 is disposed in aperture 151 and positioned between rear wheels 212 and forward wheels 214, and more preferably proximate rear wheels 212 (see, e.g., FIG. 1F).

In a preferred embodiment brake 400 disposed in aperture 151 has a released position and an engaged position. In one embodiment, brake 400 is normally engaged (e.g., against datum 50) and is released, for example, by applying a force to actuator 440 when cane 100 is used to assist a user in walking. Preferably, brake 400 is normally in a released position (e.g., a retracted position) and is only in an engaged (i.e., applied) position (e.g., engaged against datum surface 50) when a force is applied to actuator 440. In one embodiment, stopper 430 is elevated above datum 50 when brake 400 is in a retracted position. (FIG. 4A) Preferably, when brake 400 is retracted, stopper 430 remains in relatively close proximity of datum 50. In one embodiment, when brake 400 is retracted, the ground engaging surface 431 preferably is positioned between base 200 and datum 50 (e.g., FIG. 4A) and more preferably at an elevation between axle 213 and datum 50. In one embodiment, when brake 400 is retracted, stopper 430 is at least partially contained within base 200. Preferably, bias element 450 (e.g., a spring) (FIG. 4A) is secured to brake 400 and base 200. In a preferred embodiment, stopper 430 engages datum 50 when bias element 450 is compressed and returns to its normally retracted position when bias element 450 is permitted to return to it starting position. In one embodiment, brake 400 is biased in a released position. Preferably, bias element 450 is at least partially enclosed within base 200. In one embodiment, bias element 450 is substantially entirely enclosed within base 200. In a preferred embodiment, bias element 450 slidably engages base 200 at aperture 151 through grommet 451 which is preferably secured to base 200(FIG. 2). Brake 400 preferably has a bias element securement 455 that includes bias pin 452, grommet 451 and bias collar 453. Preferably bias pin 452 passes through lower brake 410 and engages bias collar 453. Bias collar 453 is preferably disposed between bias element 450 and bias pin 452.

Brake 400 preferably includes actuator 440. In one embodiment, actuator 440 contacts brake 400 (e.g., FIG. 4B). Preferably, actuator 440 is attached to brake 400. In one embodiment, actuator 440 is attached to upper brake 420. In a preferred embodiment, when actuator 440 is depressed brake 400 is engaged. In a preferred embodiment, actuator 440 is proximate to upper grip 510. In a preferred embodiment, actuator 440 is detached from upper grip 510 yet has a shape that provides a smooth transition from between actuator 440 and upper grip 510 (described in more detail herein).

In one embodiment, brake 400 provides lateral support to cane 100. Brake 400 preferably provides stiffening support (e.g., rigidity) to cane 100. In one embodiment, intermediate grip(s) 520 in combination with brake 400 provide stiffening support to cane 100 (described in more detail below).

Figure 1I:
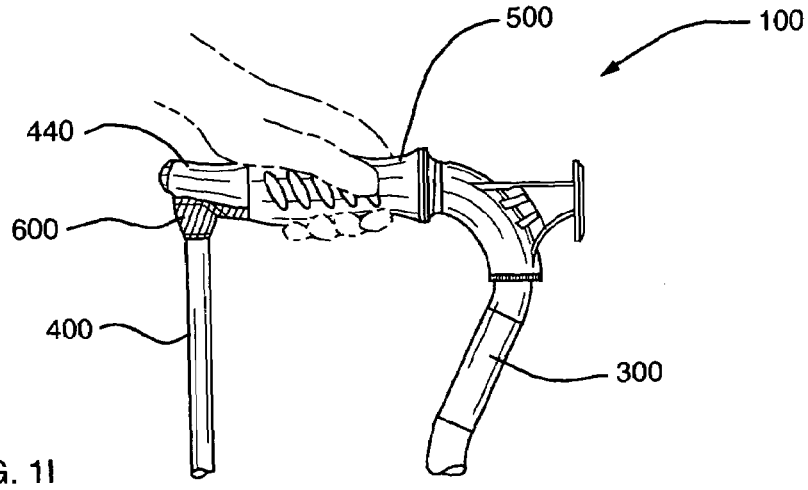
FIGS. 1I-1K depict a user operable grip and actuator according to the present invention.
Figure 1J:
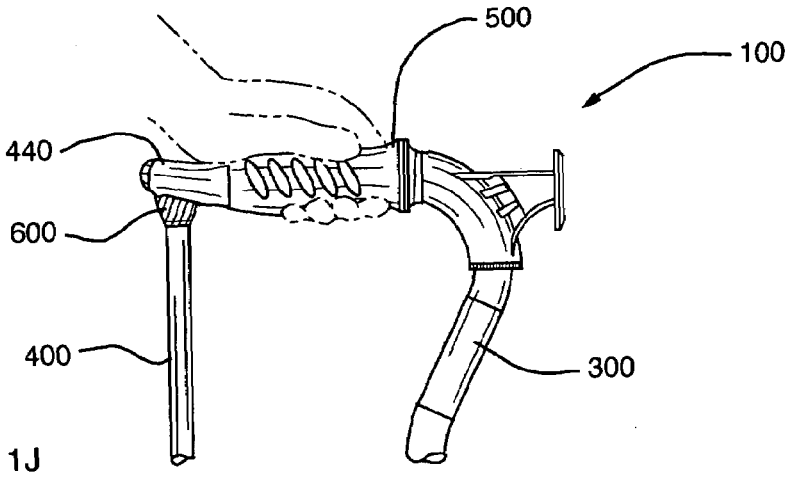
Figure 1K:
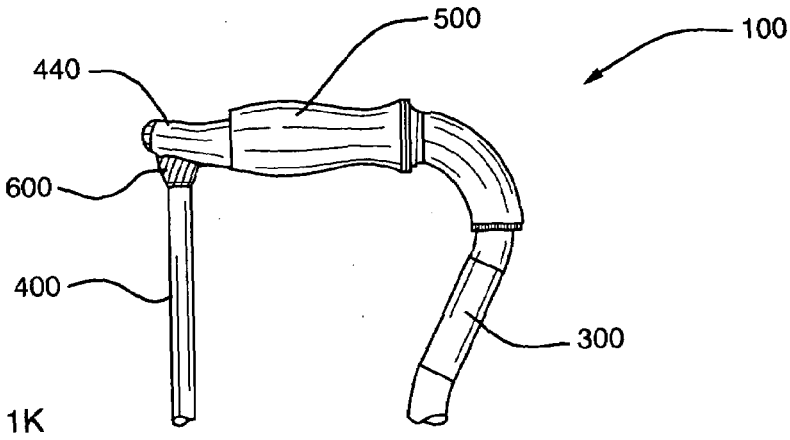
Figure 1L:
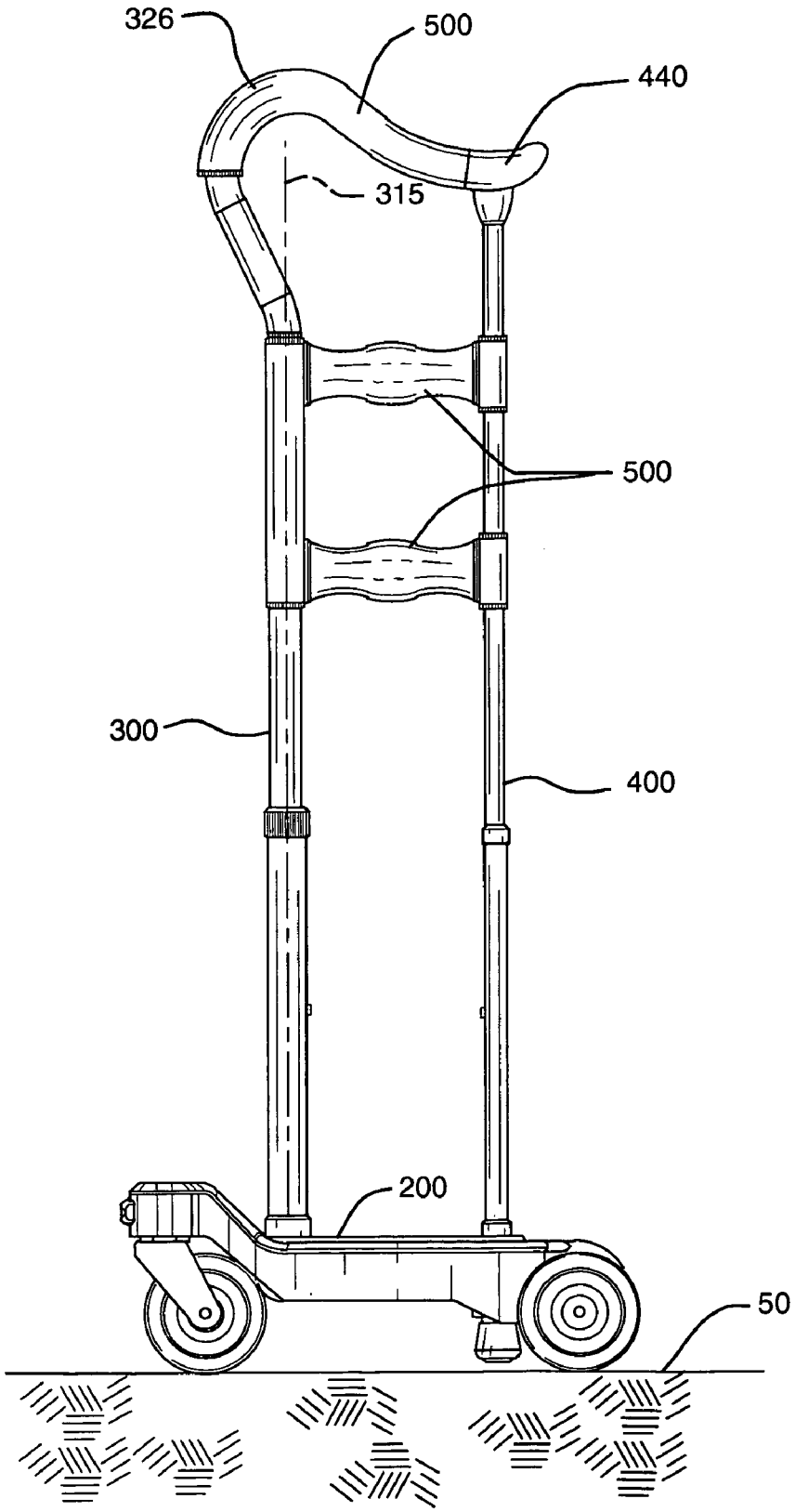
FIG. 1L depicts a cane according to the present invention.

In one embodiment, actuator 440 is disposed substantially contiguous with a grip 500 such that actuator 440 forms part of grip 500. In one embodiment, the substantially contiguous actuator 440 is displaceable with respect to at least a portion of grip 500 when the actuator is engaged to apply the brake (e.g., when a user applies the heel of a hand to actuator 440 in a downward force as illustrated in FIGS. 1I-1K). In one embodiment, the displacement of actuator 440 relative to at least a portion of grip 500 is guided (e.g., by brake guide 600) such that the actuator is returnable to its original position upon the release of the brake.

Figure 5:
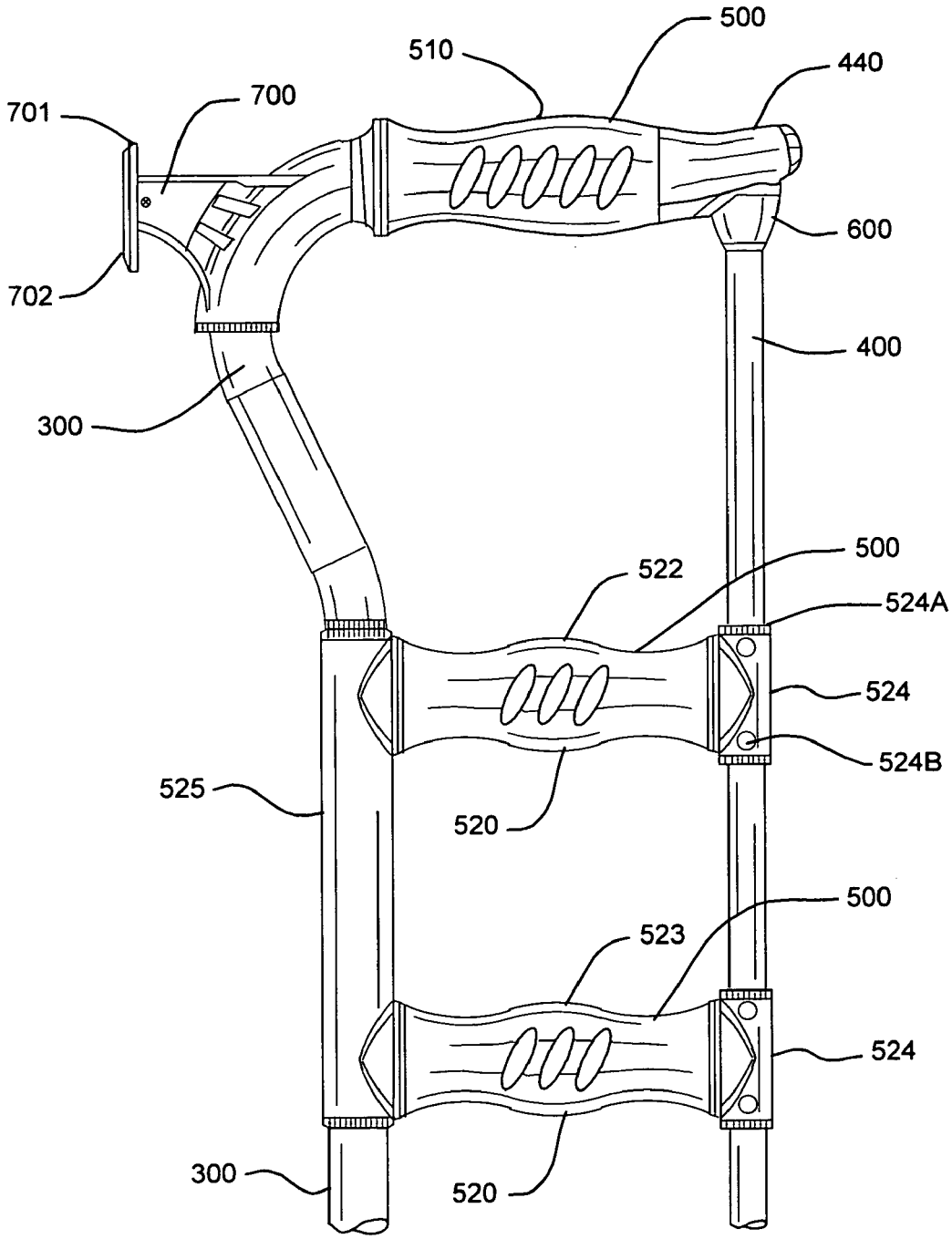
FIG. 5 depicts grips of a rolling cane shown in FIGS. 1A-1H according to the present invention.
Figures 3, 6A:
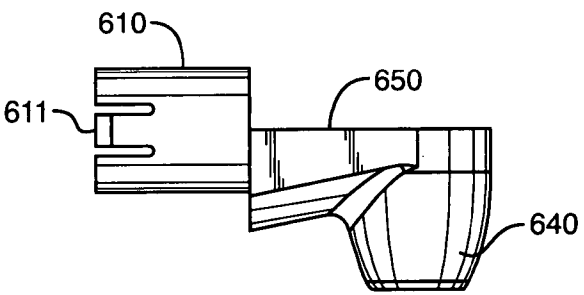
FIG. 6A-1 to 6A-6 depicts a brake guide of a rolling cane shown in FIGS. 1A-1H according to the present invention.
Figures 2, 6A:
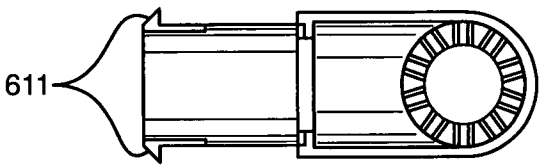
Figures 1, 6A:
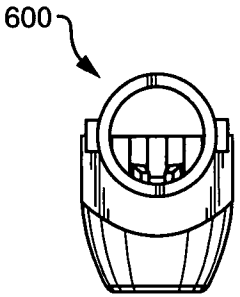
Figures 6, 6A:
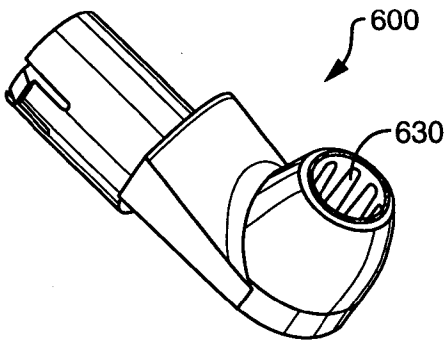
Figures 5, 6A:
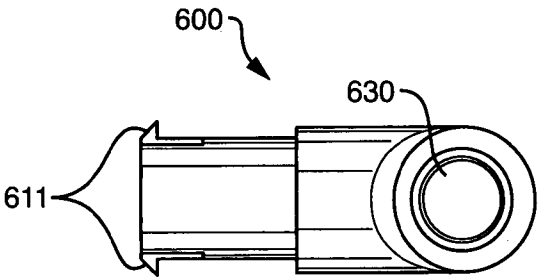
Figures 4, 6A:
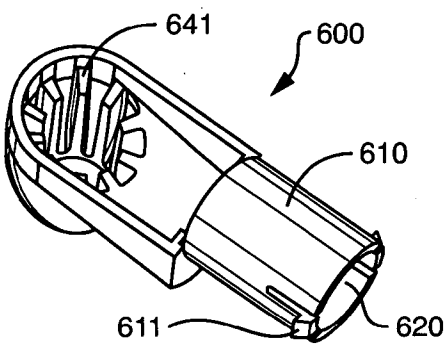
Figure 6C:
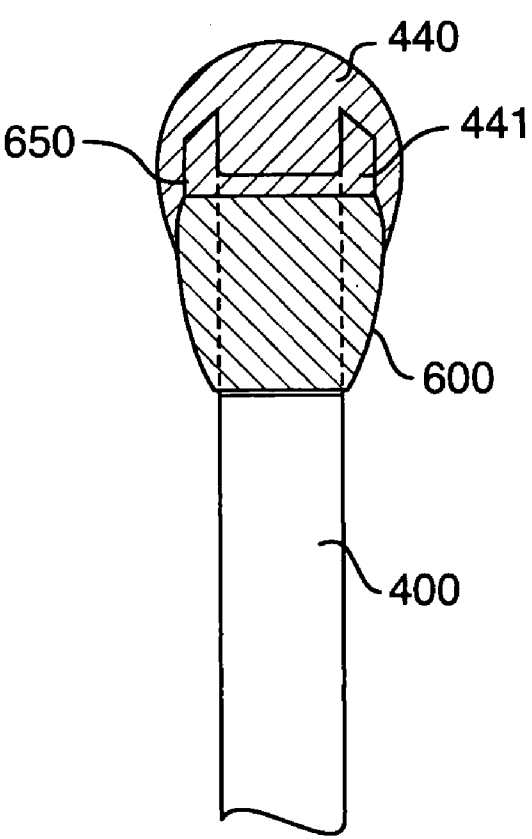
FIGS. 6B-6C illustrate a brake guide and actuator according to the present invention.
Figure 6B:
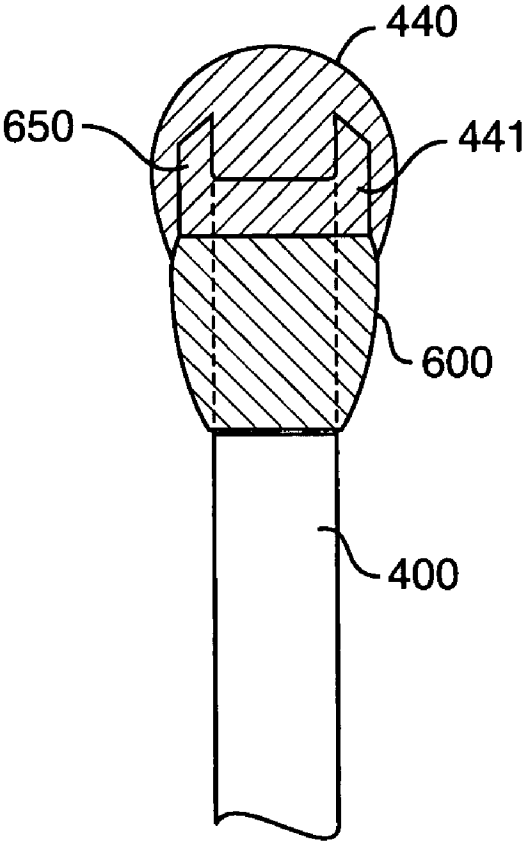
Figure 7B:
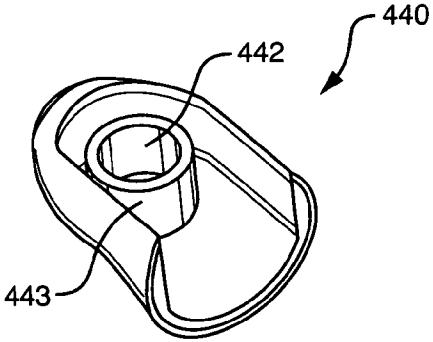
FIG. 7A to 7E depicts an actuator according to the present invention.
Figure 7A:
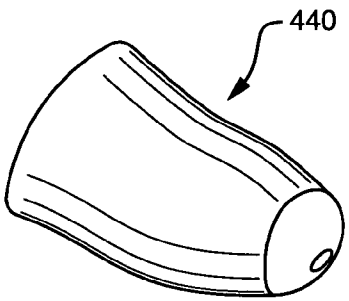
Figure 7E:
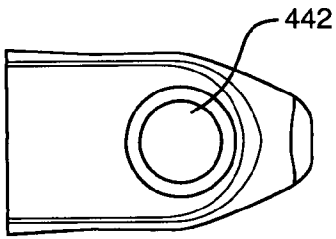
Figure 7D:
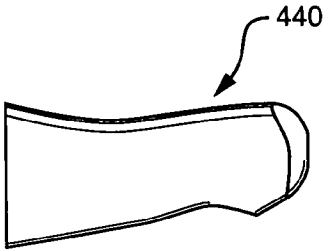
Figure 7C:
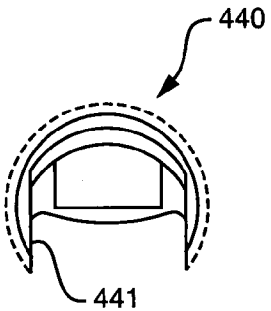
Figure 8C:
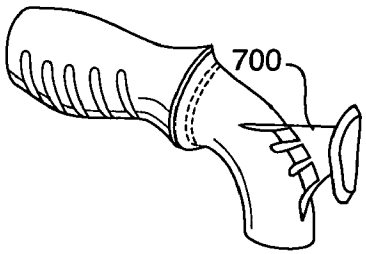
FIG. 8A to 8H depicts portions of an upper grip and accessory fixture according to the present invention.
Figure 8F:
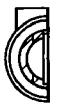
Figure 8H:
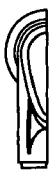
Figure 8B:
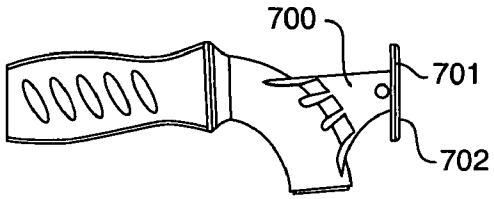
Figure 8E:
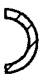
Figure 8G:
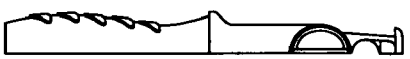
Figure 8A:
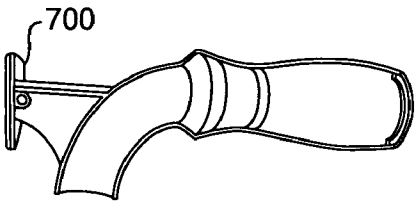
Figure 8D:
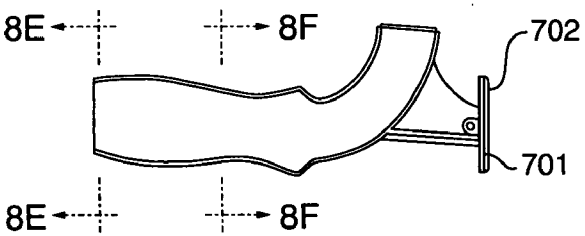

In one embodiment, cane 100 includes brake guide 600 (e.g., as illustrated in FIGS. 4B, 5, 6A-1 to 6A-6). In some embodiments, brake guide 600 substantially holds actuator 440 and brake 400 in position while brake 400 is applied and released (e.g., as described herein). In some embodiments, brake guide 600 guides actuator 440 during application and release of brake 400. In one embodiment, brake guide 600 provides a securement between shaft 300 and brake 400. In a preferred embodiment, brake guide 600 functions to secure shaft 300 to brake 400 while guiding brake 400 during application of brake 400 and releasing of brake 400 (e.g., by substantially controlling the movement of brake 400 in a limited direction (e.g., along its longitudinal axis) when in operation. Brake guide 600 preferably also functions as a guide for actuator 440 as it is depressed, for example, to operate brake 400. In one embodiment, illustrated in FIG. 6A-1 to 6A-6, brake guide 600 has lateral stub 610, lateral aperture 620, brake aperture 630, brake collar 640, and actuator guide 650. In one embodiment, lateral stub 610 is secured within shaft 300 via a friction fit. In another embodiment, stub tab 611 is snapped into window 612 (FIG. 3) to secure lateral stub 610 within shaft 300. In one embodiment, brake guide 600 is substantially immobilized within shaft 300. In one embodiment, to prevent brake 400 from binding in brake guide 600 during operation, brake guide 600 is permitted some degree of movement relative to shaft 300. In a preferred embodiment, brake guide 600 is free to slightly rotate andlor to move axially slightly relative to grip 500. In one embodiment, brake collar 640 is axially disposed about brake 400. In one embodiment, at least a portion of brake 400 is disposed within brake aperture 630. Ribs 641 are preferably disposed within brake aperture 630. In one embodiment, actuator 440 (e.g., FIGS. 6B, 6C, 7A to 7E) is disposed about actuator guide 650 (e.g., FIGS. 6A-1 to 6A-6, 6B, 6C, 7A to 7E). In one embodiment, actuator 440 is secured to brake 400 at actuator collar 443. In one embodiment, actuator collar 443 is axially disposed about brake 400 and defines actuator brake aperture 442. In one embodiment, brake 400 is disposed within actuator brake aperture 442. In one embodiment, actuator 440 includes guide aperture 441 (e.g., FIG. 7A to 7E). In one embodiment, in their normal position actuator guide 600 and actuator 440 define guide aperture 441 (FIG. 6A-1 to 6A-6). Preferably, actuator guide 650 is at least partially disposed within actuator guide aperture 441. In one embodiment, when a user engages brake 400 by depressing actuator 440, actuator 440 rides along actuator guide 650 thereby reducing guide aperture 441. (FIG. 6B)

FIGS. 1I-1K illustrate a user applying brake 400. In the embodiment illustrated in FIG. 1I, the user's hand comfortably grasps grip 500 with the heel of the user's hand located proximate actuator 440. In one embodiment, the user walks along side cane 100 while leaning on cane 100 as cane 100 rolls along side the user. FIG. 1J illustrates a user that has engaged actuator 440 without moving the hand from the grip position of FIG. 1I. In FIGS. 1I-1K when the user depresses actuator 440 with the heel of the user's hand, actuator 440 is forced downward in a displaced fashion from grip 500 (e.g., as illustrated in FIG. 1K). When depressed by the downward force of the user's hand, actuator 440 travels over actuator guide 600 while remaining stationary with respect to grip 500. In one embodiment, brake 400 slides within and is guided by actuator guide 600 and is in contact with actuator 440 (see also FIG. 4B). Thus, upon depression of actuator 440, brake 400 is urged downward thereby engaging the lower tip of brake 400 with a ground surface. In one embodiment, by returning the user's hand to the position illustrated in FIG. 1I, the brake is released and the cane is once again free to roll along with the walking user.

In a preferred embodiment, as illustrated in FIG. 5 for example, cane 100 has one or more grips 500 (e.g., handles). Preferably, cane 100 has an upper grip 510 and one or more intermediate grips 520. In one embodiment, one or more of grips 500 have centerpoints that are substantially aligned with one another. In one embodiment, cane 100 has any number of intermediate grips. Preferably cane 100 has two intermediate grips 520 (e.g., 522, 523). In one embodiment, sleeve 525 is axially disposed about shaft 300. In one embodiment, sleeve 525 is secured to or is integral with one or more intermediate grips 520. (FIG. 4B). Preferably one or more intermediate grips 520 are secured directly to brake 400, for example, by intermediate Grips 500 preferably have inner grip 502 and outer grip 504. In one embodiment, inner grip is preferably axially disposed about and is in contact with shaft 300 (e.g., lateral member 326). In one embodiment, inner grip 502 is of any material, preferably polymer, more preferably thermoplastic polymer. In one embodiment, outer grip 504 is axially disposed about and in contact with inner grip 502. In a preferred embodiment, outer grip 504 provides a layer (e.g., cushion or insulation) between a user's hand and inner grip 502 and shaft 300 (e.g., lateral 326). In a preferred embodiment, outer grip 504 is elastomer. Preferably outer grip 504 has one or more perforations 505. In one embodiment, perforations 505 provide additional comfort to a user. In one embodiment, perforations 505 are of any ornamental shape and/or orientation. In one embodiment, perforations 505 function to orient a user's hand into a preferred position on grip 500. In one embodiment, grip 100 includes raised portions that enhance comfort of a user's hand and/or placement of a user's hand upon grip 500.

Grips 500 are preferably configured to comfortably orient a user's hand to a desired position. In one embodiment, upper grip 510 has a length that is substantially the same as the length of intermediate grips 520. Upper grip 510 is configured to comfortably accept a user's hand such that the approximate center of upper grip 510 is proximate a user's palm and actuator 440 is naturally positioned proximate the heel of a user's hand. Preferably, this natural orientation of a user's hand on upper grip 510 facilitates a user's immediate application of brake 400 without the need to remove a user's hand from upper grip 510.

In one embodiment accessory fixture 700 (e.g., FIGS. 4B, 5, 8A to 8H, 9J-1 to 9J-8, 9L-1 to 9L-6) is attached to shaft 300 proximate upper grip 510. Accessory fixture 700 preferably is configured to enable a user to hang cane 100 from accessory fixture 700 (e.g., on a shopping cart). Accessory fixture 700 preferably is also configured to accept an accessory that hangs from accessory fixture 700 (e.g., an intravenous support structure, a reaching or gripping device, an oxygen source support structure). In one embodiment, accessory fixture 700 includes downward stem 702. In another embodiment, accessory fixture 700 has an upward stem 701 and a downward stem 702. In one embodiment, accessory fixture 700 includes an accessory aperture 704 and an accessory channel 705. In one embodiment, accessory aperture 704 andlor accessory channel 705 accommodate one or more accessories such as intravenous poles, and/or reaching or gripping devices. Thus, for example, an accessory having a shaft (e.g., an intravenous pole) may be disposed within accessory aperture 704 such that it is readily accessible to a user. In one embodiment, accessory channel 705 has a shape that is configured to match the shape of an accessory that may be disposed within or along channel 705 for accessibility to a user. In one embodiment, base 200 includes a feature (not shown) (e.g., a depression, tab, aperture) that is aligned with accessory aperture 704 such that an accessory (e.g., an intravenous pole) may be secured between accessory fixture 700 and base 200.

In one embodiment, cane 100 is configured to assist a user's mobility by supporting a user's weight while the user is walking without the need for the user to lift the cane, for example, between steps.

The embodiments of the present invention described above may be independently incorporated in the rolling/braking cane of the present invention. Alternatively, any two or more of the embodiments described (including those described in documents incorporated by reference herein) can be combined into a single cane of the present invention. Although the foregoing description is directed to preferred embodiments of the invention, it is noted that other variations and modifications in the details, materials, steps and arrangement of parts, which have been herein described and illustrated in order to explain the nature of the preferred embodiment of the invention, and may be made without departing from the spirit or scope of the invention. Any dimensions referenced herein are exemplary dimensions of certain embodiments of the invention.

The invention claimed is:

1. A cane comprising:

a base having at least one wheel and an aperture;

a support shaft having a user adjustable length and a first end connected to the base;

a brake disposed within the aperture having a user adjustable length; and at least one grip connected to the support shaft and the grip being operably engaged with the brake wherein the at least one grip includes a plurality of intermediate grips, each grip being configured to apply the brake with application of downward force and being configured to release the brake with the removal of the downward force.

2. The cane of claim 1 wherein the at least one wheel comprises two rear wheels that rotate about a common axis and two forward castors.

3. The cane of claim 1 wherein the base has a bumper disposed on a front face of the base.

4. The cane of claim 1 wherein at least one of the grips includes an actuator that is displaceable relative to a portion of the grip to engage the brake.

5. The cane of claim 1 wherein the at least one grip further comprises an outer grip having an aperture defining an ornamental feature.

6. The cane of claim 1 wherein the brake is configured to form a stiffening member for the cane.

7. The cane of claim 1 wherein the brake operably engages a bias element configured to bias the brake in a released position.

8. The cane of claim 1 wherein the base has a stepped vertical profile.

9. The cane of claim 8 wherein the at least one wheel comprises two castors secured to an upper portion of the stepped vertical profile base and two fixed axle wheels secured to a lower portion of the stepped vertical profile base.

10. The cane of claim 9 wherein the brake is disposed proximate the fixed axle wheels and passes through the stepped vertical profile base to be engageable with a ground surface.

11. The cane of claim 1 wherein the at least one wheel comprises forward wheels and rearward wheels and the brake is disposed between the forward wheels and the rearward wheels.

12. The cane of claim 11 wherein the brake is proximate a forward end of the rearward wheels.

13. The cane of claim 1 wherein the at least one grip is configured to permit a user to apply the brake while the user's hand is comfortably positioned on the at least one grip.

14. A cane comprising:

a base having at least one wheel and an aperture;

a support shaft having a user adjustable length and a first end connected to the base;

a brake disposed within the aperture having a user adjustable length; and at least one grip connected to the support shaft and the grip being operably engaged with the brake wherein the cane includes at least one brake guide that engages one of the at least one grip, wherein the brake guide comprises a brake collar that positions the brake, and an actuator guide disposed within the actuator and configured to guide the actuator when it is displaced from the grip to apply the brake.

15. The cane of claim 12 wherein the brake is configured to form a stiffening member.

16. The cane of claim 12 further comprising a bumper disposed on a front face of the base.

17. The cane of claim 14 wherein the at least one grip includes an actuator that is displaceable relative to a portion of the at least one grip to engage the brake.

18. The cane of claim 14 wherein the base has a stepped vertical profile.

19. The cane of claim 12 wherein the at least one wheel comprises two castors secured to an upper portion of the stepped vertical profile base and two fixed axle wheels secured to a lower portion of the stepped vertical profile base and wherein the brake is disposed proxinate the fixed axle wheels and passes through the stepped vertical profile base to be engageable with a ground surface.

20. A cane comprising:

a base having at least one wheel and an aperture;

a support shaft having a user adjustable length and a first end connected to the base;

a brake disposed within the aperture having a user adjustable length; and at least one grip connected to the support shaft and the grip being operably engaged with the brake wherein the brake is configured to form a stiffening member for the cane;

wherein the base has a stepped vertical profile;

wherein the at least one wheel comprises two castors secured to an upper portion of the stepped vertical profile base and two fixed axle wheels secured to a lower portion of the stepped vertical profile base; and wherein the brake is disposed proximate the fixed axle wheels and passes through the stepped vertical profile base to be engageable with a ground surface.

* * * * *